US006996523B1

(12) United States Patent
Bhaskar et al.

(10) Patent No.: US 6,996,523 B1
(45) Date of Patent: Feb. 7, 2006

(54) PROTOTYPE WAVEFORM MAGNITUDE QUANTIZATION FOR A FREQUENCY DOMAIN INTERPOLATIVE SPEECH CODEC SYSTEM

(75) Inventors: Udaya Bhaskar, North Potomac, MD (US); Kumar Swaminathan, North Potomac, MD (US)

(73) Assignee: Hughes Electronics Corporation, El Segundo, CA (US)

( * ) Notice: Subject to any disclaimer, the term of this patent is extended or adjusted under 35 U.S.C. 154(b) by 739 days.

(21) Appl. No.: 10/073,128

(22) Filed: Feb. 13, 2002

Related U.S. Application Data

(60) Provisional application No. 60/314,288, filed on Aug. 23, 2001, provisional application No. 60/268,327, filed on Feb. 13, 2001.

(51) Int. Cl.
*G10L 19/10* (2006.01)

(52) U.S. Cl. ..... 704/222; 704/219; 704/230

(58) Field of Classification Search ..... 704/207, 704/216, 221, 222, 223, 230, 219, 265
See application file for complete search history.

(56) References Cited

U.S. PATENT DOCUMENTS 5,517,595 A 5/1996 Kleijn
5,664,055 A 9/1997 Kroon
5,717,823 A 2/1998 Kleijn
5,781,880 A 7/1998 Su
5,784,532 A * 7/1998 McDonough et al. ..... 704/224
5,809,456 A * 9/1998 Cucchi et al. ..... 704/217
5,884,010 A 3/1999 Chen et al.
5,884,253 A 3/1999 Kleijn
5,890,105 A 3/1999 Ishihara et al.
5,911,128 A * 6/1999 DeJaco ..... 704/200.1
6,081,776 A 6/2000 Grabb et al.
6,324,505 B1 * 11/2001 Choy et al. ..... 704/230
6,418,408 B1 7/2002 Bhaskar et al.
6,493,664 B1 12/2002 Bhaskar et al.
6,691,092 B1 * 2/2004 Udaya Bhaskar et al. .. 704/265

OTHER PUBLICATIONS

Kleijn et al., "A Speech Coder Based on Decomposition of Characteristic Waveforms," IEEE, 1995, pp. 508-511.

(Continued)

*Primary Examiner*—Abul K. Azad
(74) *Attorney, Agent, or Firm*—Craig Plastrik

(57) ABSTRACT

A system and method is provided that employs a frequency domain interpolative CODEC system for low bit rate coding of speech which comprises a linear prediction (LP) front end adapted to process an input signal that provides LP parameters which are quantized and encoded over predetermined intervals and used to compute a LP residual signal. An open loop pitch estimator adapted to process the LP residual signal, a pitch quantizer, and a pitch interpolator and provide a pitch contour within the predetermined intervals is also provided. Also provided is a signal processor responsive to the LP residual signal and the pitch contour and adapted to perform the following: provide a voicing measure, where the voicing measure characterizes a degree of voicing of the input speech signal and is derived from several input parameters that are correlated to degrees of periodicity of the signal over the predetermined intervals; extract a prototype waveform (PW) from the LP residual and the open loop pitch contour for a number of equal sub-intervals within the predetermined intervals; normalize the PW by a gain value of the PW; encode a magnitude of the PW; and directly quantize the PW in a magnitude domain without further decomposition of the PW into complex components, where the direct quantization is performed by a hierarchical quantization method based on a voicing classification using fixed dimension vector quantizers (VQ's).

8 Claims, 10 Drawing Sheets

OTHER PUBLICATIONS

Thomson, "Parametric Models of the Magnitude/Phase Spectrum for Harmonic Speech Coding," IEEE, 1988, pp. 378-381.

Sen, et al., "Synthesis Methods in Sinusoidal And Waveform-Interpolation Coders", Speech Coding Research Department AT&T Bell Laboratories, Murray Hill, NJ, pp. 79-80.

* cited by examiner

PROTOTYPE WAVEFORM MAGNITUDE QUANTIZATION FOR A FREQUENCY DOMAIN INTERPOLATIVE SPEECH CODEC SYSTEM

CROSS REFERENCE TO RELATED APPLICATIONS

This application claims benefit under 35 U.S.C. §119(e) from U.S. Provisional Patent Application Ser. No. 60/268,327 filed on Feb. 13, 2001, and from U.S. Provisional Patent Application Ser. No. 60/314,288 filed on Aug. 23, 2001, the entire contents of both of said provisional applications being incorporated herein by reference.

BACKGROUND OF THE INVENTION

1. Field of the Invention

The present invention relates to a method and system for coding low bit rate speech for communication systems. More particularly, the present invention relates to a method and apparatus for performing prototype waveform magnitude quantization using vector quantization.

2. Background of the Invention

Currently, various speech encoding techniques are used to process speech. These techniques do not adequately address the need for a speech encoding technique that improves the modeling and quantization of a speech signal, specifically, the evolving spectral characteristics of a speech prediction residual signal which includes a prototype waveform (PW) gain vector, a PW magnitude vector, and a PW phase information.

In particular, prior art techniques are representative but not limited to the following see, e.g., L. R. Rabiner and R. W. Schafer, "Digital Processing of Speech Signals" Prentice-Hall 1978 (hereinafter known as reference 1), W. B. Klejin and J. Haagen, "Waveform Interpolation for Coding and Synthesis", in Speech Coding and Synthesis, Edited by W. B. Klejin, K. K. Paliwal, Elsevier, 1995 (hereinafter known as reference 2); F. Iatakura, "Line Spectral Representation of Linear Predictive Coefficients of Speech Signals", Journal of Acoustical Society of America, vol 4. 57, no. 1, 1975 (hereinafter known as reference 3); P. Kabal and R. P. Ramachandran, "The Computation of Line Spectral Frequencies Using Chebyshev Polybimials", IEEE Trans. On ASSP, vol. 34, no. 6, pp. 1419–1426, December 1986 (hereinafter known as reference 4); W. B. Klejin, "Encoding Speech Using Prototype Waveforms" IEEE Transactions on Speech and Audio Processing, Vol. 1, No. 4, 386–399, 1993 (hereinafter known as reference 5); and W. B. Kleijn, Y. Shoman, D. Sen and R. Hagen, "A Low Complexity Waveform Interpolation Coder", IEEE International Conference on Acoustics, Speech and Signal Processing, 1996 (hereinafter known as reference 6). All of the references 1 through 6 are herein incorporated in their entirety by reference.

The prototype waveforms are a sequence of complex Fourier transforms evaluated at pitch harmonic frequencies, for pitch period wide segments of the residual, at a series of points along the time axis. Thus, the PW sequence contains information about the spectral characteristics of the residual signal as well as the temporal evolution of these characteristics. A high quality of speech can be achieved at low coding rates by efficiently quantizing the important aspects of the PW sequence.

In PW based coders, the PW is separated into a shape component and a level component by computing the RMS (or gain) value of the PW and normalizing the PW to a unity RMS value. As the pitch frequency varies, the dimensions of the PW vectors also vary, typically in the range of 11–61. Existing VQ techniques, such as direct VQ, split VQ and multi-stage VQ are not well suited for variable dimension vectors. Adaptation of these techniques for variable dimension is not neither practical from an implementation viewpoint nor satisfactory from a performance viewpoint. It's not practical since the worst case high dimensionality results in a high computational cost and a high storage cost.

To address the variable dimensionality problem, prior art in reference 4 uses analytical functions of a fixed order to approximate the variable dimension vectors. The coefficients of the analytical function that provide the best fit to the vectors are used to represent the vectors for quantization. This approach suffers from three disadvantages. First, a modeling error is added to the quantization error, leading to a loss in performance. Second, analytical function approximation for reasonable orders in the magnitude of 5–10 deteriorate with increasing frequency. Third, if spectrally weighted distortion metrics are used during VQ, the complexity of these methods become formidable.

A PW magnitude vector sequence determines the evolving spectral characteristics of a linear predictive (LP) excitation signal and therefore is important in signal characterization. Prior art techniques separate the PW sequence into slowly evolving (SEW) and rapidly evolving (REW) components. This results in two disadvantages.

First the algorithmic delay of the coding scheme in prior art is significantly increased as it requires linear low pass and high pass filtering to separate the SEW and REW components. This delay can be noticeable in telephone conversations.

Second, the signal processing in prior art needed for this purpose is complicated due to the filtering that is necessary. This increases the computational complexity of processing the signal resulting higher cost.

Additionally, prior art techniques use a non-hierachical approach in quantizing the PW vectors (see references 2–6). This results in lower CODEC performance and less robustness to channel errors.

Thus, a need exists for a system and method that can accurately recreate perceptually important spectral features of the PW magnitude while maintaining computational and storage efficiency. Specifically, this permits the evolving spectral features of the LP residual signal to be reproduced accurately at the decoder.

SUMMARY OF THE INVENTION

An object of the present invention is to provide a system and method for accurately representing the spectral features of the LP residual signal and for reproducing the spectral features accurately at the decoder.

These and other objects are substantially achieved by a system and method employing a frequency domain interpolative CODEC system for low bit rate coding of speech. The CODEC comprises a linear prediction (LP) front end adapted to process an input signal that provides LP parameters which are quantized and encoded over predetermined intervals and used to compute a LP residual signal. An open loop pitch estimator adapted to process the LP residual signal, a pitch quantizer, and a pitch interpolator and provide a pitch contour within the predetermined intervals is also provided. Also provided is a signal processor responsive to the LP residual signal and the pitch contour and adapted to perform the following: provide a voicing measure, where the voicing measure characterizes a degree of voicing of the input speech signal and is derived from several input parameters that are correlated to degrees of periodicity of the signal over the predetermined intervals; extract a prototype waveform (PW) from the LP residual and the open loop pitch contour for a number of equal sub-intervals within the predetermined intervals; normalize the PW by a gain value of the PW; encode a magnitude of the PW; and directly quantize the PW in a magnitude domain without further decomposition of the PW into complex components, where the direct quantization is performed by a hierarchical quantization method based on a voicing classification using fixed dimension vector quantizers (VQ's).

BRIEF DESCRIPTION OF THE DRAWINGS

The various objects, advantages and novel features of the present invention will be more readily understood from the following detailed description when read in conjunction with the appended drawings, in which.

Throughout the drawing figures, like reference numerals will be understood to refer to like parts and components.

DETAILED DESCRIPTION OF PREFERRED EMBODIMENTS

Figure 1A:
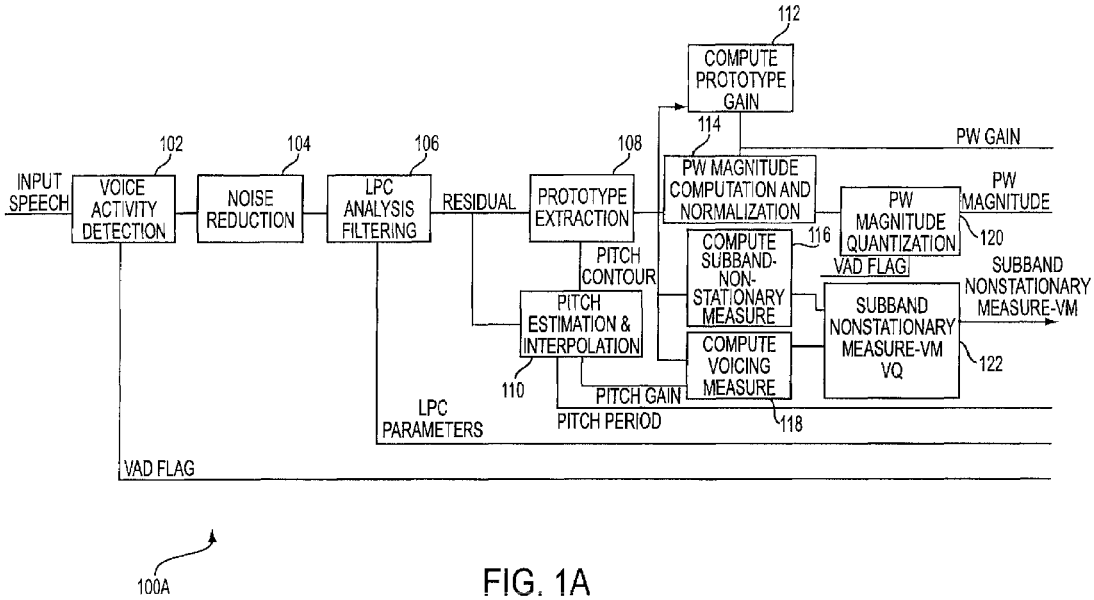
FIGS. 1A and 1B are block diagrams of a Frequency Domain Interpolative (FDI) coder/decoder (CODEC) for performing coding and decoding of an input voice signal in accordance with an embodiment of the present invention.
Figure 1B:
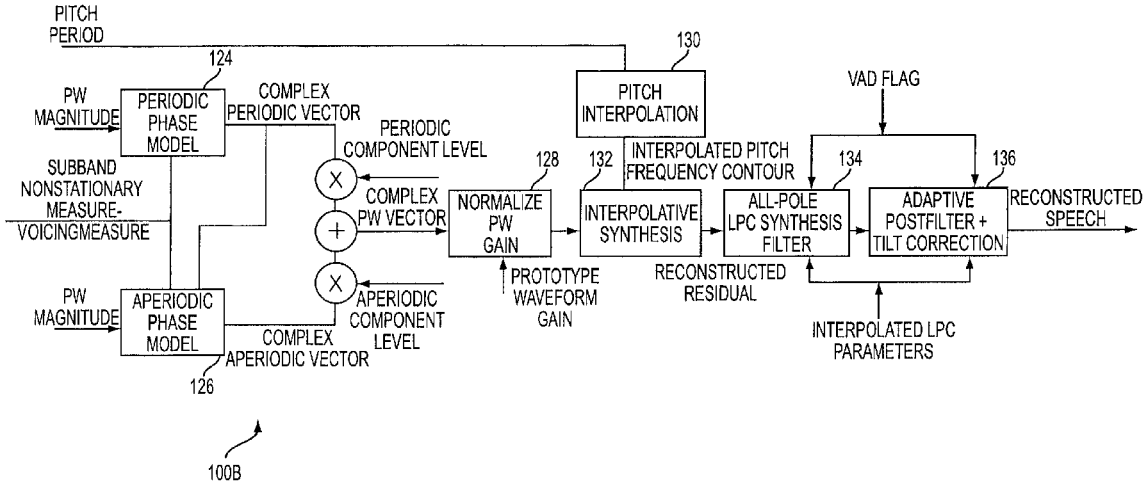

FIGS. 1A and 1B are block diagrams of a Frequency Domain Interpolative (FDI) coder/decoder (CODEC) 100 for performing coding and decoding of an input voice signal in accordance with an embodiment of the present invention. The FDI CODEC 100 comprises a coder portion 100A which computes prototype waveforms (PW) and a decoder portion 100B which reconstructs the PW and speech signal.

Specifically, the coder portion 100A illustrates the computation of PW from an input speech signal. Voice activity detection (VAD) 102 is performed on the input speech to determine whether the input speech is actually speech or noise. The VAD 102 provides a VAD flag which indicates whether the input signal was noise or speech. The detected signal is then provided to a noise reduction module 104 where the noise level for the signal is reduced and provided to a linear predictive (LPC) analysis filter module 106.

The LPC module 106 provides filtered and residual signals to the prototype extraction module 108 as well as LPC parameters to decoder 100B. The pitch estimation and interpolation module 110 receives the LPC filtered and residual signals from the LPC analysis filter module 106 and pitch contours from the prototype extraction module 108 and provides a pitch and a pitch gain.

The extracted prototype waveform from prototype extraction module 108 is provided to compute prototype gain module 112, PW magnitude and computation and normalization module 114, compute subband nonstationarity measure module 116 and compute voicing measure module 118. Compute voicing measure (VM) module 118 also receives the pitch gain from pitch estimation and interpolation module 110 and computes a voicing measure.

The compute prototype gain module 112 computes a prototype gain and provides the PW gain value to decoder portion 100B. PW magnitude computation and normalization module 114 computes the PW magnitude and normalizes the PW magnitude.

Compute subband nonstationarity measure module 116 computes a subband nonstationarity measure from the extracted prototype waveform. The computed subband nonstationarity measure and computed voicing measure are provided to a subband nonstationarity measure—Vector quantizer (VQ) module 122 which processes the received signals.

A PW magnitude quantization module 120 receives the computed PW magnitude and normalized signal along with the VAD flag indication and quantizes the received signal and provides a PW magnitude value to the decoder 100B.

The decoder 100B further includes a periodic phase model module 124 and aperiodic phase model module 126 which receive the PW magnitude value and subband nonstationarity measure-voicing measure value from coder 100A and compute a periodic phase and an aperiodic phase, respectively, from the received signal. The periodic phase model module 124 provides a complex periodic vector having a periodic component level and the aperiodic phase model module 126 provides a complex aperiodic vector having an aperiodic component level to a summer which provides a complex PW vector to a normalize PW gain module 128. The normalize PW gain module also receives the PW gain value from coder 100A.

A pitch interpolation module 130 performs pitch interpolation on a pitch period provided by encoder 100A. The normalize PW gain signal and interpolated pitch frequency contour signal is provided to an interpolative synthesis module 132 which performs interpolative synthesis to obtain a reconstructed residual signal from the previously mentioned signals.

The reconstructed residual signal is provided to an all pole LPC synthesis filter module 134 which processes the reconstructed residual signal and provides the filtered signal to an adaptive postfilter and tilt correction module 136. Modules 134 and 136 also receive the VAD flag indication signal and interpolated LPC parameters from the encoder 100A. A reconstructed speech signal is provided by the adaptive postfilter and tilt correction module 136.

Specifically, the FDI codec 100 is based on techniques of linear predictive (LP) analysis, robust pitch estimation and frequency domain encoding of the LP residual signal. The FDI codec operates on a frame size of preferably 20 ms. Every 20 ms, the speech encoder 100A produces 80 bits representing compressed speech. The speech decoder 100B receives the 80 compressed speech bits and reconstructs a 20 ms frame of speech signal. The encoder 100A preferably uses a look ahead buffer of at least 20 ms, resulting in an algorithmic delay comprising buffering delay and look ahead delay of 40 ms.

The speech encoder 100A is equipped with a built-in voice activity detector (VAD) 102 and can operate in continuous transmission (CTX) mode or in discontinuous transmission (DTX) mode. In the DTX mode, comfort noise information (CNI) is encoded as part of the compressed bit stream during silence intervals. At the decoder 100B, the CNI packets are used by a comfort noise generation (CNG) algorithm to regenerate a close approximation of the ambient noise. The VAD information is also used by an integrated front end noise reduction scheme that can provide varying degrees of background noise level attenuation and speech signal enhancement.

A single parity check bit is preferably included in the 80 compressed speech bits of each frame of the input speech signal to detect channel errors in perceptually important compressed speech bits. This enables the codec 100 to operate satisfactorily in links with a random bit error rate up to about $10^{-3}$. In addition, the decoder 100B uses bad frame concealment and recovery techniques to extend signal processing operations during frame erasures.

Additionally, in addition to the speech coding functions, the codec 100 also has the ability to transparently pass dual tone multifrequency (DTMF) and signaling tones.

As discussed above, the FDI codec 100 uses the linear predictive analysis technique to model the short term Fourier spectral envelope of the input speech signal. Subsequently, a pitch frequency estimate is used to perform a frequency domain prototype waveform analysis of the LP residual signal. Specifically, the PW analysis provides a characterization of the harmonic or fine structure of the speech spectrum. More specifically, the PW magnitude spectrum provides the correction necessary to refine the short term LP spectral estimate to obtain a more accurate fit to the speech spectrum at the pitch harmonic frequencies. Information about the phase of the signal is implicitly represented by the degree of periodicity of the signal measured across a set of subbands.

In a preferred embodiment of the present invention, the input speech signal is processed in consecutive non-overlapping frames of 20 ms duration, which corresponds to 160 samples at the sampling frequency of 8000 samples/sec. The encoder 100A parameters are quantized and transmitted once for each 20 ms frame. A look-ahead of 20 ms is used for voice activity detection, noise reduction, LP analysis and pitch estimation. This produces in an algorithmic delay which is defined as a buffering delay and a look-ahead delay of 40 ms.

Figure 2:
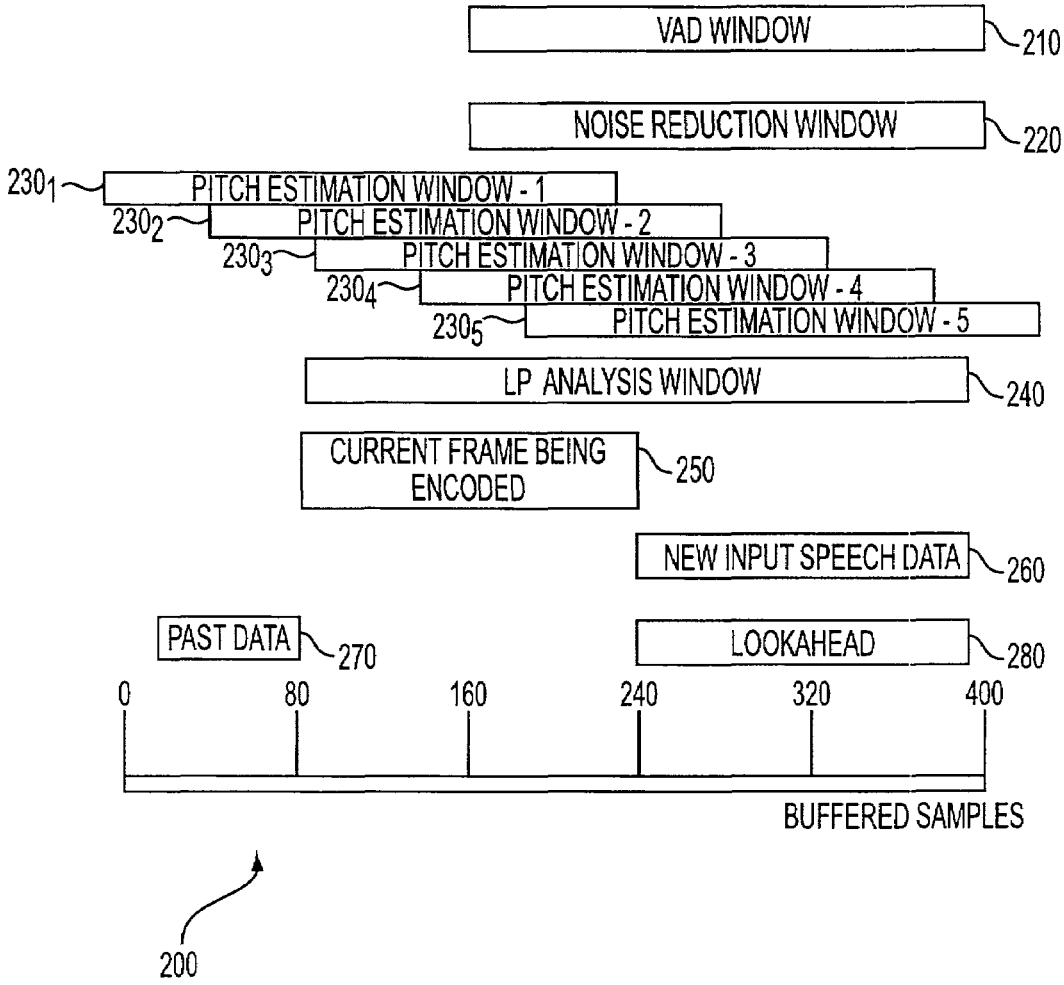
FIG. 2 is a block diagram of frame structures for use with the CODEC of FIG. 1 in accordance with an embodiment of the present invention.

Referring to FIG. 2 which illustrates the samples used for various functions at the encoder 100A, an estimated size of buffered samples for various frames is shown. For example, a VAD window 210 uses buffered samples from about 160 to 400 samples. A noise reduction window 220 uses about the same number of samples. Pitch estimation windows $\mathbf{230}_1$ up to $\mathbf{230}_5$ each uses about 240 samples. The LP analysis window processes the signal in about 80 to 400 samples. A current frame being encoded is processed between 80 to 240 samples. A new input speech data 260 and look-ahead 280 are processed from about 240 to 400 samples while a past data is processed from zero to 80 samples. For the purposes of excitation modeling, each frame is further divided into 8 subframes preferably of duration 2.5 ms or 20 samples.

The invention will now be discussed in terms of front end processing, specifically input preprocessing. The new input speech samples are first scaled down by preferably 0.5 to prevent overflow in fixed point implementation of the coder 100A. In another embodiment of the present invention, the scaled speech samples can be high-pass filtered using an infinite impulse response (IIR) filter with a cut-off frequency of 60 Hz, to eliminate undesired low frequency components. The transfer function of the 2nd order high pass filter is given by $$H_{hpf1}(z) = \frac{0.939819335 - 1.879638672\, z^{-1} + 0.939819335\, z^{-2}}{1 - 1.933195469\, z^{-1} + 0.935913085\, z^{-2}} \quad (1)$$

In terms of the VAD module 102, the preprocessed signal is analyzed to detect the presence of speech activity. This comprises the following operations: scaling the signal via an automatic gain control (AGC) mechanism to improve VAD performance for low level signals, windowing the Automatic Gain Control (AGC) scaled speech and computing a set of autocorrelation lags, performing a $10^{th}$ order autocorrelation LP analysis of the AGC scaled speech to determine a set of LP parameters which are used during pitch estimation, performing a preliminary pitch estimation based on the pitch candidates for the look-ahead part of the buffer, performing voice activity detection based on the autocorrelation lags and pitch estimate and the tone detection flag that is generated by examining the distance between adjacent line spectral frequencies (LSFs) which will be described in greater detail below with respect to conversion to line spectral frequencies.

This series of operations produces a VAD_FLAG and a VID_FLAG that have the following values depending on the detected voice activity:

$$\text{VAD_FLAG} = \begin{cases} 1 & \text{if voice activity is present,} \\ 0 & \text{if voice activity is absent.} \end{cases}$$

$$\text{VID_FLAG} = \begin{cases} 0 & \text{if voice activity is present,} \\ 1 & \text{if voice activity is absent.} \end{cases}$$

It should be noted that the VAD_FLAG and the VID_FLAG represent the voice activity status of the look-ahead part of the buffer. A delayed VAD flag, VAD_FLAG_DL1 is also maintained to reflect the voice activity status of the current frame. In a presentation given during an IEEE speech and audio processing workshop in Finland during 1999, the entire contents of the documentation being incorporated by reference herein, the presenters F. Basbug, S. Nandkumar and K. Swamianthan described an AGC front-end for the VAD which itself is a variation of the voice activity detection algorithms used in cellular standards "TDMA cellular/PCS Radio Interface—Minimum Objective Standards for IS-136 B, DTX/CNG Voice Activity Detection", which is also incorporated by reference in its entirety. A by-product of the AGC front-end is the global signal-to-noise ratio, which is used to control the degree of noise reduction.

The VAD flag is encoded explicitly only for unvoiced frames as indicated by the voicing measure flag. Voiced frames are assumed to be active speech. In the present embodiment of the invention, the VAD flag is not coded explicitly. The decoder sets the VAD flag to a one for all voiced frames. However, it will be appreciated by those skilled in the art that the VAD flag can be coded explicitly without departing from the scope of the present invention.

Noise reduction module 104 provides noise reduction to the voice activity detected speech signal. Specifically, the preprocessed speech signal is processed by a noise reduction algorithm to produce a noise reduced speech signal. The following is a series of steps comprising the noise reduction algorithm: A trapezoidal windowing and the computing of the complex discrete Fourier transform (DFT) of the signal is performed. FIG. 2 depicts the part of the buffer that undergoes the DFT operation. A 256-point DFT (240 windowed samples+16 padded zeros) is used. The magnitude of the DFT is smoothed along the frequency axis across a variable window whose width is about 187.5 Hz in the first 1 KHz, about 250 Hz in the range of 1–2 KHz, and about 500 Hz in the range of 2–4 KHz regions. These values reflect a compromise between the conflicting objectives of preserving the format structure and having sufficient smoothness of the speech signal.

If the VVAD_FLAG, which is the VAD output prior to hangover, is a one which indicates voice activity, then the smoothed magnitude square of the DFT is taken to be the smoothed power spectrum of noisy speech S(k). However, if the VVAD_FLAG is a zero indicating voice inactivity, the smoothed DFT power spectrum is then used to update a recursive estimate of the average noise power spectrum $N_{av}(k)$ as follows:

$$N_{av}(k)=0.9\cdot N_{av}(k)+0.1\cdot S(k) \text{ if } VAD_FLAG=0 \tag{2}$$

A spectral gain function is then computed based on the average noise power spectrum and the smoothed power spectrum of the noisy speech. The gain function $G_{nr}(k)$ takes the following form:

$$G_{nr}(k)=\frac{S(k)}{F_{nr}N_{av}(k)+S(k)} \tag{3}$$

Here, the factor $F_{nr}$ is a factor that depends on the global signal-to-noise-ratio $SNR_{global}$ that is generated by the AGC front-end for the VAD. The factor $F_{nr}$ can be expressed as an empirically derived piecewise linear function of $SNR_{global}$ that is monotonically non-decreasing. The gain function is close to unity when the smoothed power spectrum S(k) is much larger than the average noise power spectrum $N_{av}(k)$. Conversely, the gain function becomes small when S(k) is comparable to or much smaller than $N_{av}(k)$. The factor $F_{nr}$ controls the degree of noise reduction by providing for a higher degree of noise reduction when the global signal-to-noise ratio is high (i.e., risk of spectral distortion is low since VAD and the average noise estimate are fairly accurate). Conversely, the factor restricts the amount of noise reduction when the global signal-to-noise ratio is low. For example, the risk of spectral distortion is high due to increased VAD inaccuracies and less accurate average noise power spectral estimate.

The spectral amplitude gain function is further clamped to a floor which is a monotonically non-increasing function of the global signal-to-noise ratio. This kind of clamping reduces the fluctuations in the residual background noise after noise reduction making the speech sound smoother. The clamping action is expressed as:

$$G'_{nr}(k)=\mathrm{MAX}(G_{nr}(k),\ T_{global}(SNR_{global})) \tag{4}$$

Thus, at high global signal-to-noise ratios, the spectral gain functions will be clamped to a lower floor since there is less risk of spectral distortion due to inaccuracies in the VAD or the average noise power spectral estimate $N_{av}(k)$. But at lower global signal-to-noise ratio, the risks of spectral distortion outweigh the benefits of reduced noise and therefore a higher floor would be appropriate.

In order to reduce the frame-to-frame variation in the spectral amplitude gain function, a gain limiting device is used which limits the gain between a range that depends on the previous frame's gain for the same frequency. The limiting action can be expressed as follows:

$$G_{nr}^{new}(k)=\mathrm{MAX}(\{S_{nr}^{L}.G_{nr}^{old}(k)\},\ \mathrm{MIN}(\{S_{nr}^{H}.G_{nr}^{old}(k)\},G'_{nr}(k))) \tag{5}$$

The scale factors $S_{nr}^{L}$ and $S_{nr}^{H}$ are updated using a state machine whose actions depend on whether the frame is active, inactive or transient.

Figure 3:
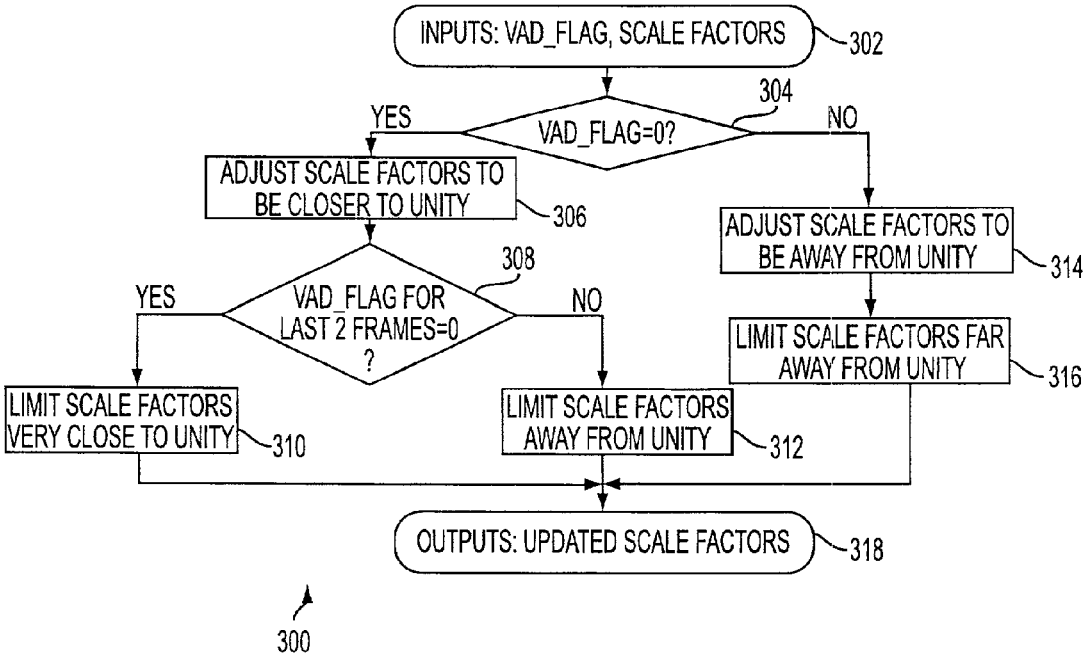
FIG. 3 is a flow chart for a method for updating scale factors to limit spectral amplitude gain in performing noise reduction in accordance with an embodiment of the present invention.

FIG. 3 depicts a flowchart 300 which performs scale factor updates in accordance with an embodiment of the present invention. The process 300 is occrs in noise reduction module 104 and is initiated at step 302 where input values VAD_FLAG and scale factors are received. The method 300 then proceeds to step 304 where a determination is made as to whether the VAD_FLAG is zero which indicates voice activity is absent. If the determination is affirmative the method 300 proceeds to step 306 where the scale factors are adjusted to be closer to unity. The method 300 then proceeds to step 308.

At step 308 a determination is made as to whether the VAD_FLAG was zero for the last two frames. If the determination is affirmative the method proceeds to step 310 where the scale factors are limited to be very close to unity. However, if the determination was negative, the method 300 then proceeds to step 312 where the scale factors are limited to be away from unity.

If the determination at step 304 was negative, the method 300 then proceeds to step 314 where the scale factors are adjusted to be away from unity. The method 300 then proceeds to step 316 where the scale factors are limited to be far away from unity.

The steps 310, 312 and 316 proceed to step 318 where the updated scale factors are outputted.

The final spectral gain function $G_{nr}^{new}(k)$ is multiplied with the complex DFT of the preprocessed speech, attenuating the noise dominant frequencies and preserving signal dominant frequencies. An overlap-and-add inverse DFT is then performed on the spectral gain scaled DFT to compute a noise reduced speech signal over the interval of the noise reduction window.

Since the noise reduction is carried out in the frequency domain, the availability of the complex DFT of the preprocessed speech is taken advantage of in order to carry out DTMF and Signaling tone detection. These detection schemes are based on examination of the strength of the power spectra at the tone frequencies, the out-of-band energy, the signal strength, and validity of the bit duration pattern. It should be noted that the incremental cost of having such detection schemes to facilitate transparent transmission of these signals is negligible since the power spectrum of the preprocessed speech is already available.

An embodiment of the invention will now be described in terms of LPC analysis filtering module 106. The noise reduced speech signal is subjected to a $10^{th}$ order autocorrelation method of LP analysis where $\{s_{nr}(n), 0\leqq n<400\}$ denotes the noise reduced speech buffer, where $\{s_{nr}(n),$ $80 \leqq n < 240\}$ is the current frame being encoded and $\{s_{nr}(n), 240 \leqq n < 320\}$ is the look-ahead buffer 280 as shown in FIG. 2. In the LP analysis of speech, the magnitude spectrum of short segments of speech is modeled by the magnitude frequency response of an all-pole minimum phase filter, whose transfer function is represented by $$H_{lp}(z) = \frac{1}{\sum_{m=0}^{M} a_m z^{-m}} \tag{6}$$

Here, $\{a_m, 0 \leqq m \leqq M\}$ are the LP parameters for the current frame and M=10 is the LP order. LP analysis is performed using the autocorrelation method with a modified Hanning window of size 40 ms (320 samples) which includes the 20 ms current frame and the 20 ms lookahead frame as shown in FIG. 2.

The noise reduced speech signal over the LP analysis window $\{s_{nr}(n), 80 \leqq n < 400\}$ is windowed using a modified Hanning window function $\{w_{lp}(n), 0 \leqq n < 320\}$ defined as follows:

$$w_{lp}(n) = \begin{cases} 0.5 - 0.5\cos\left(\frac{2\pi n}{319}\right), & 0 \le n < 240, \\ \frac{\left(0.5 - 0.5\cos\left(\frac{2\pi n}{319}\right)\right)}{\cos^2\left(\frac{2\pi(n-240)}{320}\right)}, & 240 \le n < 320. \end{cases} \tag{7}$$

The windowed speech buffer is computed by multiplying the noise reduced speech buffer with the window function as follows:

$$s_w(n) = s_{nr}(80+n) w_{lp}(n) 0 \leqq n < 240. \tag{8}$$

Normalized autocorrelation lags are computed from the windowed speech by $$r_{lp}(m) = \frac{\sum_{n=0}^{319-m} s_w(n) s_w(n+m)}{\sum_{n=0}^{319} s_w^2(n)} \quad 0 \le m \le 10, \tag{9}$$

The autocorrelation lags are windowed by a binomial window with a bandwidth expansion of 60 Hz. The binomial window is given by the following recursive rule:

$$l_w(m) = \begin{cases} 1 & m = 0 \\ l_w(m-1)\frac{4995 - m}{4995 + m} & 1 \le m \le 10. \end{cases} \tag{10}$$

Lag windowing is performed by multiplying the autocorrelation lags by the binomial window:

$$r_{lpw}(m) = r_{lp}(m) l_w(m) 1 \leqq m \leqq 10. \tag{11}$$

The zeroth windowed lag $r_{lpm}(0)$ is obtained by multiplying by a white noise correction factor of about 1.0001, which is equivalent to adding a noise floor at −40 dB:

$$r_{lpw}(0) = 1.0001 r_{lp}(0). \tag{12}$$

Lag windowing and white noise correction are techniques are used to address problems that arise in the case of periodic or nearly periodic signals. For such signals, the all-pole LP filter is marginally stable, with its poles very close to the unit circle. It is necessary to prevent such a condition to ensure that the LP quantization and signal synthesis at the decoder 100B an be performed satisfactorily.

The LP paramerters that define a minimum phase spectral model to the short term spectrum of the current frame are determined by applying Levinson-Durbin recursions to the windowed autocorrelation lags $\{r_{lpw}(m), 0 \leqq m \leqq 10\}$. The resulting $10^{th}$ order LP parameters for the current frame are $\{a'_m, 0 \leqq m \leqq 10\}$, with $a'_0 = 1$. Since the LP analysis window is centered around the sample index of about 240 in the buffer, the LP parameters represent the spectral characteristics of the signal in the vicinity of this point.

During highly periodic signals, the spectral fit provided by the LP model tends to be excessively peaky in the low formant regions, resulting in audible distortions. To overcome this problem, a bandwidth broadening scheme has been employed in this embodiment of the present invention, where the formant bandwidth of the model is broadened adaptively, depending on the degree of peakiness of the spectral model. The LP spectrum is given by $$S(e^{jw}) = \frac{1}{\sum_{m=0}^{M} a'_m e^{-jwm}} \quad -\pi \le w \le \pi. \tag{13}$$

where $\omega_m$ denotes the pitch frequency estimate of the $m^{th}$ subframe ($1 \leqq m \leqq 8$) of the current frame in radians/sample. Given this pitch frequency, the index of the highest frequency pitch harmonic that falls within the frequency band of the signal (0–4000 Hz or 0–π radians) for the $m^{th}$ subframe is given by $$K_m = \left\lfloor \frac{\pi}{\omega_m} \right\rfloor \quad 1 \le m \le 8, \tag{14}$$

where, $\lfloor x \rfloor$ denotes the largest integer less than or equal to x. The magnitude of the LPC spectrum is evaluated at the pitch harmonics by $$|S(k)| = |S(e^{j\omega_8 k})| = \frac{1}{\left|\sum_{m=0}^{M} a'_m e^{-j\omega_8 km}\right|} \quad 0 \le k \le K_8. \tag{15}$$

It should be noted that $\omega_8$ corresponds to the $8^{th}$ subframe has been used here since the LP parameters have been evaluated for a window centered around a sample of about 240 as shown in FIG. 2. A logarithmic peak-to-average ratio of the harmonic spectral magnitudes is computed as $$PAR = 10\log_{10}\left\{\frac{\max_{1 \le k \le K_8}|S(k)|}{\frac{1}{(K_8 - 1)}\left\{\sum_{k=1}^{K_8}|S(k)| - \max_{1 \le k \le K_8}|S(k)|\right\}}\right\}. \tag{16}$$

The peak-to-average ratio ranges from 0 dB (for flat spectra) to values exceeding 20 dB (for highly peaky spectra). The expansion in formant bandwidth (expressed in Hz) is then determined based on the log peak-to-average ratio according to a piecewise linear characteristic:

$$dw_{lp} = \begin{cases} 10 + 2PAR, & PAR \le 5, \\ 20 + 12(PAR - 5), & PAR \le 10, \\ 80 + 4(PAR - 10), & PAR \le 20, \\ 120 & PAR > 20. \end{cases} \quad (17)$$

The expansion in bandwidth ranges from a minimum of about 10 Hz for flat spectra to a maximum of about 120 Hz for highly peaky spectra. Thus, the bandwidth expansion is adapted to the degree of peakiness of the spectra. The above piecewise linear characteristic have been experimentally optimized to provide the right degree of bandwidth expansion for a range of spectral characteristics. A bandwidth expansion factor $\alpha_{bw}$ to apply this bandwidth expansion to the LP spectrum is obtained by $$\alpha_{bw} = e^{-\frac{\pi dw_{lp}}{8000}}. \quad (18)$$

The LP parameters representing the bandwidth expanded LP spectrum are determined by $$\alpha_m = \alpha'_m \alpha_{bw}{}^m 0 \leqq m \leqq 10. \quad (19)$$

The bandwidth expanded LP filter coefficients are converted to line spectral frequencies (LSFs) for quantization and interpolation purposes which is described in "Line Spectral Representation of Linear Predictive Coefficients of Speech Signals" Journal of Acoustical Society of America, vol. 57, no. 1, 1975 by F. Itakura which is incorporated by reference in its entirety. An efficient approach to computing LSFs from LP parameters using Chebychev polynomials is described in "The Computation of Line Spectral Frequencies Using Chebyshev Polynomials," IEEE Trans. On ASSP, vol. 34, no 6, pages 1419–1426, December 1986 by P. Kabal and R. P. Ramachandran which is herein incorporated by reference in its entirety. The resulting LSFs for the current frame are denoted by $\{\lambda(m), 0 \leqq m \leqq 10\}$.

The LSF domain also lends itself to detection of highly periodic or resonant inputs. For such signals, the LSFs located near the signal frequency have very small separations. If the minimum difference between adjacent LSF values falls below a threshold for a number of consecutive frames, it is highly probable that the input signal is a tone.

Figure 4:
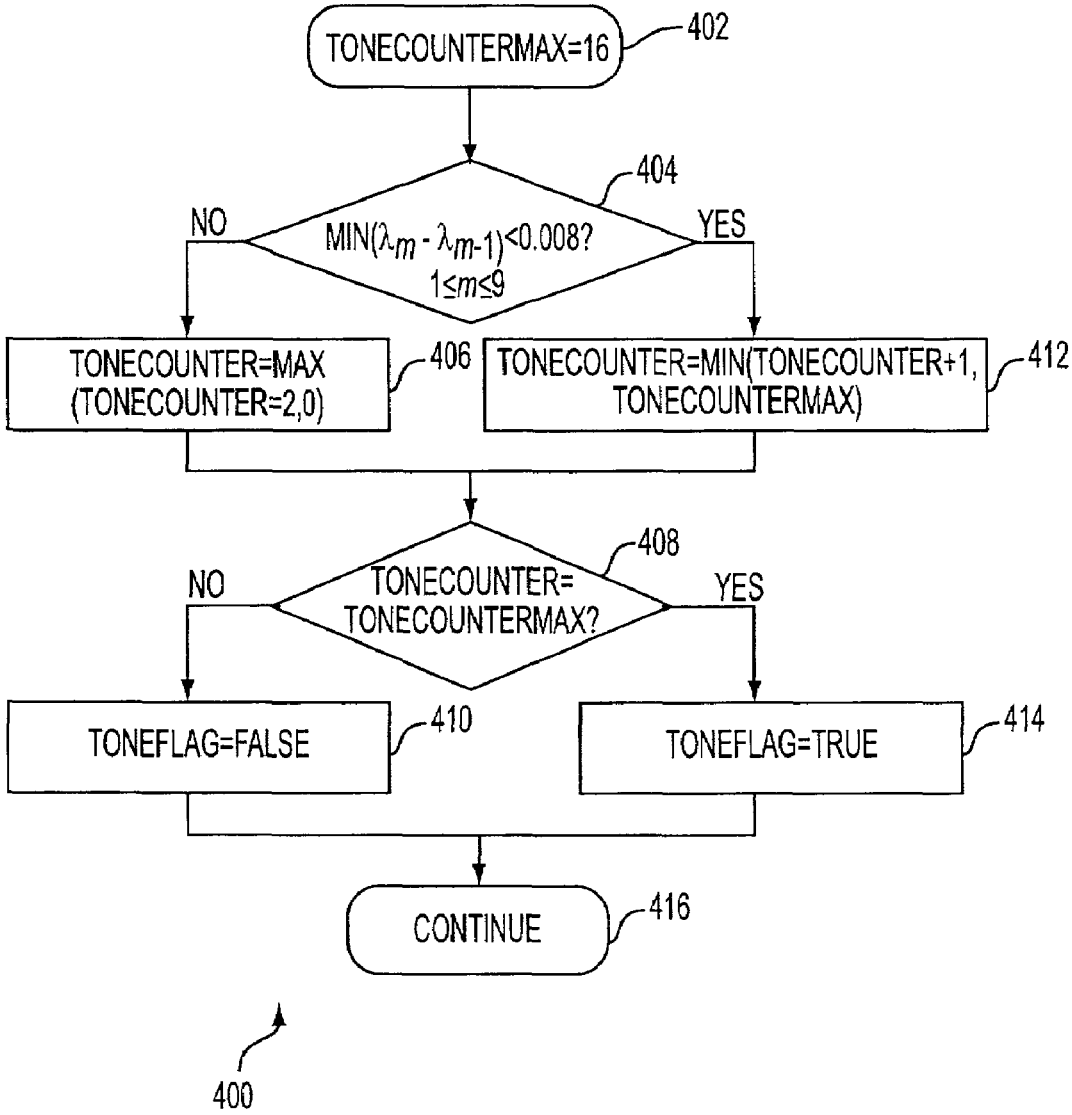
FIG. 4 is a flow chart for a method for performing tone detection in accordance with an embodiment of the present invention.

FIG. 4 describes a method 400 for tone detection in accordance with an embodiment of the present invention. The method 400 occurs in LPC analysis filtering module 106 and is initiated at step 402 where a tone counter is set illustratively for a maximum of 16. The method 400 then proceeds to step 404 where a determination is made as to whether the LSF value falls below a minimum threshold of for example 0.008. If the determination is answered negatively, the method 400 then proceeds to step 406 where the tone counter detects that the LSF value is above the threshold.

If the method 404 is answered affirmatively, the tone counter detects that the LSF value is below the threshold and increments the counter by one. The methods 406 and 412 proceed to step 408.

At step 408 a determination is made as to whether the tone counter is at its maximum value. If the method 408 is answered negatively, the method 400 proceeds to step 410 where a tone flag equals false indication is provided. If the method 408 is answered negatively, the method 400 then proceeds to step 414 where a tone flag equals true indication is provided.

The steps 410 and 414 proceed to step 416 where the method 400 continues checking for tones. Specifically, method 400 provides a tone flag indication which is a one if a tone has been detected and a zero otherwise. This flag is also used in voice activity detection.

The invention will now be described in reference to the pitch estimation and interpolation module 110. Pitch estimation is performed based on an autocorrelation analysis of a spectrally flattened low pass filtered speech signal. Spectral flattening is accomplished by filtering the AGC scaled speech signal using a pole-zero filter, constructed using the LP parameters of AGC scaled speech signal. If $\{a_m{}^{agc}, 0 \leqq m \leqq 10\}$ are the LP parameters of AGC scaled speech signal, the pole-zero filter is given by $$H_{sf}(z) = \frac{\sum_{m=0}^{M} a_m^{agc} z^{-m}}{\sum_{m=0}^{M} a_m^{agc} (0.8)^m z^{-m}}. \quad (20)$$

The spectrally flattened signal is low-pass filtered by a $2^{nd}$ order IIR filter with a 3 dB cutoff frequency of 1000 Hz. The transfer function of this filter is $$H_{lpf1}(z) = \frac{0.06745527 - 0.134910548\, z^{-1} + 0.06745527\, z^{-2}}{1 - 1.14298050\, z^{-1} + 0.41280159\, z^{-2}}. \quad (21)$$

The resulting signal is subjected to an autocorrelation analysis in two stages. In the first stage, a set of four raw normalized autocorrelation functions (ACF) are computed over the current frame. The windows for the raw ACFs are staggered by 40 samples as shown in FIG. 2. The raw ACF for the $i^{th}$ window is computed by $$r_{raw}(i, l) = \frac{\sum_{n=40(i-1)}^{40(i-1)+239-l} s_{sf}(n) s_{sf}(n+l)}{\sum_{n=40(i-1)}^{40(i-1)+239} s_{sf}^2(n)} \quad 15 \le l \le 125, \quad 2 \le i \le 5. \quad (22)$$

In each frame, raw ACFs corresponding to windows 2, 3, 4 and 5 as shown in FIG. 2 are computed. In addition, a raw ACF for window 1 is preserved from the previous frame. For each raw ACF, the location of the peak within the lag range $20 \leqq l \leqq 120$ is determined.

In the second stage, each raw ACF is reinforced by the preceding and the succeeding raw ACF, resulting in a composite ACF. For each lag l in the raw ACF in the range $20 \leqq l \leqq 120$, peak values within a small range of lags $[(l - w_c(l)), (l + w_c(l))]$ are determined in the preceding and the succeeding raw ACFs. These peak values reinforce the raw ACF at each lag l, via a weighted combination:

$$r_{comp}(i, l) = \frac{w_c(l) + 1 - 0.1 m_{peak}(l)}{(w_c(l) + 1)} \left[ \max_{l - w_c(l) \le m \le l + w_c(l)} r_{raw}(i-1, m) \right] + \quad (23)$$

-continued $$r_{raw}(i, l) + \frac{w_c(l) + 1 - 0.1n_{peak}(l)}{(w_c(l) + 1)}\left[\underset{l-w_c(l)\le n\le l+w_c(l)}{\text{MAX}} r_{raw}(i+1, n)\right]$$

$$20 \le l \le 120,\ 2 \le i \le 5.$$

Here, $w_c(l)$ determines the window length based on the lag index l:

$$w_c(l) = \begin{cases} 2 & l < 30 \\ \lfloor 0.05l + 0.5 \rfloor & 30 \le l \le 70 \\ 4 & l > 70. \end{cases} \tag{24}$$

Also, $m_{peak}(l)$ and $n_{peak}(l)$ are the locations of the peaks within the window. The weighting attached to the peak values from the adjacent ACFs ensures that the reinforcement diminishes with increasing difference between the peak location and the lag l. The reinforcement boosts a peak value if peaks also occur at nearby lags in the adjacent raw ACFs. This increases the probability that such a peak location is selected as the pitch period. ACF peaks locations due to an underlying periodicity do not change significantly across a frame. Consequently, such peaks are strengthened by the above process. On the other hand, spurious peaks are unlikely to have such a property and consequently are diminished. This improves the accuracy of pitch estimation.

Within each composite ACF the locations of the two strongest peaks are obtained. These locations are the candidate pitch lags for the corrresponding pitch window, and take values in the range 20–120 which is inclusive. In conjunction with the two peaks from the last composite ACF of the previous frame i.e., for window 5 in the previous frame, results in a set of 5 peak pairs, leading to 32 possible pitch tracks through the current frame. A pitch metric is used to maximize the continuity of the pitch track as well as the value of the ACF peaks along the pitch track to select one of these pitch tracks. The end point of the optimal pitch track determines the pitch period $p_8$ and a pitch gain $\beta_{pitch}$ for the current frame. Note that due to the position of the pitch windows, the pitch period and pitch gain are aligned with the right edge of the current frame The pitch period is integer valued and takes on values in the range 20–120. It is mapped to a 7-bit pitch index $l^*_p$ in the range of about 0–101.

In respect to the prototype extraction module 108 and the pitch estimation and interpolation module 110, the pitch period is converted to the radian pitch frequency corresponding to the right edge of the frame by $$\omega_8 = \frac{2\pi}{p_8}. \tag{24}$$

A subframe pitch frequency contour is created by linearly interpolating between the pitch frequency of the left edge $\omega_0$ and the pitch frequency of the right edge $\omega_8$:

$$\omega_m = \frac{(8-m)\omega_0 + m\omega_8}{8},\quad 1 \le m \le 8. \tag{25}$$

If there are abrupt discontinuities between the left edge and the right edge pitch frequencies, the above interpolation is modified to make a switch from the pitch frequency to its integer multiple or submultiple at one of the subframe boundaries. It should be noted that the left edge pitch frequency $\omega_o$ is the right edge pitch frequency of the previous frame. The index of the highest pitch harmonic within the 4000 Hz band is computed for each subframe by $$K_m = \left\lfloor \frac{\pi}{\omega_m} \right\rfloor,\quad 1 \le m \le 8. \tag{26}$$

The LSFs are quantized by a hybrid scalar-vector quantization scheme. The first 6 LSFs are scalar quantized using a combination of intraframe and interframe prediction using 4 bits/LSF. The last 4 LSFs are vector quantized using 7 bits. Thus, a total of 31 bits are used for the quantization of the 10-dimensional LSF vector.

The 16 level scalar quantizers for the first 6 LSFs in a preferred embodiment of the present invention is designed using a Linde-Buzo-Gray algorithm. An LSF estimate is obtained by adding each quantizer level to a weighted combination of the previous quantized LSF of the current frame and the adjacent quantized LSFs of the previous frame:

$$\tilde{\lambda}(l, m) = \begin{cases} S_{L,m}(l) + 0.375\hat{\lambda}_{prev}(m+1), & m = 0, \\ S_{L,m}(l) + 0.375\left(\hat{\lambda}_{prev}(m+1) - \hat{\lambda}_{prev}(m-1)\right) + \hat{\lambda}(m-1), & 1 \le m \le 5, \end{cases} \tag{27}$$

$$0 \le l \le 15.$$

Here, $\{\lambda(m), 0 \leqq m < 6\}$ are the first 6 quantized LSFs of the current frame and $\{\lambda_{prev}(m), 0 \leqq m \leqq 10\}$ are the quantized LSFs of the previous frame. $\{S_{L,m}(l), 0 \leqq m < 6, 0 \leqq l \leqq 15\}$ are the 16 level scalar quantizer tables for the first 6 LSFs. The squared distortion between the LSF and its estimate is minimized to determine the optimal quantizer level:

$$\underset{0\le l\le 15}{\text{MIN}}\left(\lambda(m) - \tilde{\lambda}(l, m)\right)^2 \quad 0 \le m \le 5. \tag{28}$$

If $l^*_{L_S_m}$ is the value of l that minimizes the above distortion, the quantized LSFs are given by:

$$\hat{\lambda}(m) = \begin{cases} S_{L,m}(l^*_{L_S_m}) + 0.375\hat{\lambda}_{prev}(m+1), & m = 0, \\ S_{L,m}(l^*_{L_S_m}) + 0.375\left(\hat{\lambda}_{prev}(m+1) - \hat{\lambda}_{prev}(m-1)\right) + \hat{\lambda}(m-1), & 1 \le m \le 5. \end{cases} \tag{29}$$

The last 4 LSFs are vector quantized using a weighted mean squared error (WMSE) distortion measure. The weight vector $\{W_L(m), 6 \leqq m \leqq 9\}$ is computed by the following procedure:

$$p1(m) = \prod_{i=0,2,4,6,8} \{4 + \cos^2(2\pi\lambda(m)) + \cos^2(2\pi\lambda(i)) - 8\cos(2\pi\lambda(m))\cos(2\pi\lambda(i))\}, \quad 6 \le m \le 9. \tag{30}$$

$$p2(m) = \prod_{i=1,3,5,7,9} \{4 + \cos^2(2\pi\lambda(m)) + \cos^2(2\pi\lambda(i)) - 8\cos(2\pi\lambda(m))\cos(2\pi\lambda(i))\}, \quad 6 \le m \le 9. \tag{31}$$

$$W_L m = \left[\frac{1.09 - 0.6\cos(2\pi\lambda(m))}{(0.5 + 0.5\cos(2\pi\lambda(m))p1(m) + (0.5 - 0.5\cos(2\pi\lambda(m))p2(m)}\right]^{025}, \quad 6 \le m \le 9. \tag{32}$$

A set of predetermined mean values $\{\lambda_{dc}(m), 6 \leqq m < 9\}$ are used to remove the DC bias in the last 4 LSFs prior to quantization. These LSFs are estimated based on the mean removed quantized LSFs of the previous frame:

$$\lambda(l,m) = V_L(l,m-6) + \lambda_{dc}(m) + 0.5(\lambda_{prev}(m) - \lambda_{dc}(m)), 0 \leqq l \leqq 127, 6 \leqq m \leqq 9. \tag{33}$$

Here $\{V_L(l,m), 0 \leqq l \leqq 127, 0 \leqq m < 3\}$ is the 128 level, 4-dimensional codebook for the last 4 LSFs. The optimal code vector is determined by minimizing the WMSE between the estimated and the original LSF vectors:

$$\underset{0 \le l \le 127}{\mathrm{MIN}} \sum_{m=6}^{9} W_L(m)(\lambda(m) - \tilde{\lambda}(l, m))^2. \tag{34}$$

If $l^*_{L_V}$ is the value of l that minimizes the above distortion, the quantized LSF subvector is given by:

$$\lambda(m) = V_L(l^*_{L_V}, m-6) + \lambda_{dc}(m) + 0.5(\lambda_{prev}(m) - \lambda_{dc}(m)), 6 \leqq m \leqq 9. \tag{35}$$

The stability of the quantized LSFs is checked by ensuring that the LSFs are monotonically increasing and are separated by a minimum value of about 0.008. If this criteria is not satisfied, stability is enforced by reordering the LSFs in a monotonically increasing order. If a minimum separation is not achieved, the most recent stable quantized LSF vector from a previous frame is substituted for the unstable LSF vector. The 6 4-bit SQ indices $\{l^*_{L_S_m} \leqq m \leqq 5\}$ and the 7-bit VQ index $l^*_{L_V}$ are transmitted to the decoder. Thus the LSFs are encoded using a total of 31 bits.

The inverse quantized LSFs are interpolated each subframe by preferably linear interpolation between the current LSFs $\{\lambda(m), 0 \leqq m \leqq 10\}$ and the previous LSFs $\{\lambda_{prev}(m), 0 \leqq m \leqq 10\}$. The interpolated LSFs at each subframe are converted to LP parameters 7 $\{\hat{a}_m(1), 0 \leqq m \leqq 10, 1 \leqq l \leqq 8\}$.

The prediction residual signal for the current frame is computed using the noise reduced speech signal $\{s_{nr}(n)\}$ and the interpolated LP parameters. Residual is computed from the midpoint of a subframe to the midpoint of the next subframe, using the interpolated LP parameters corresponding to the center of this interval. This ensures that the residual is computed using locally optimal LP parameters. The residual for the past data as shown in FIG. 2 is preserved from the previous frame and is also used for PW extraction.

Further, residual computation extends 93 samples into the look-ahead part of the buffer to facilitate PW extraction. LP parameters of the last subframe are used computing the look-ahead part of the residual. By denoting the interpolated LP parameters for the $j^{th}$ subframe ($0 \leqq j \leqq 8$) of the current frame by $\{\hat{a}_m(j), 0 \leqq m \leqq 10\}$, residual computation can be represented by:

$$e_{lp}(n) \begin{cases} \sum_{m=0}^{M} s_{nr}(n-m)\hat{a}_m(0) & 80 \le n \le 90, \\ \sum_{m=0}^{M} s_{nr}(n-m)\hat{a}_m(j) & 1 \le j \le 7 \quad 20j + 70 \le n < 20j + 90, \\ \sum_{m=0}^{M} s_{nr}(n-m)\hat{a}_m(8) & 230 \le n \le 332. \end{cases}$$

The residual for past data, $\{e_{lp}(n), 0 \leqq n < 80\}$ is preserved from the previous frame.

The invention will now be discussed in reference to PW extraction. The prototype waveform in the time domain is essentially the waveform of a single pitch cycle, which contains information about the characteristics of the glottal excitation. A sequence of PWs contains information about the manner in which the excitation is changing across the frame. A time-domain PW is obtained for each subframe by extracting a pitch period long segment approximately centered at each subframe boundary. The segment is centered with an offset of up to ±10 samples relative to the subframe boundary, so that the segment edges occur at low energy regions of the pitch cycle. This minimizes discontinuities between adjacent PWs. For the $m^{th}$ subframe, the following region of the residual waveform is considered to extract the PW:

$$\left\{e_{lp}(80 + 20m + n), -\frac{p_m}{2} - 12 \le n \le \frac{p_m}{2} + 12\right\} \tag{37}$$

where $p_m$ is the interpolated pitch period (in samples) for the $m^{th}$ subframe. The PW is selected from within the above region of the residual, so as to minimize the sum of the energies at the beginning and at the end of the PW. The energies are computed as sums of squares within a 5-point window centered at each end point of the PW, as the center of the PW ranges over the center offset of about ±10 samples:

$$E_{end}(i) = \sum_{j=-2}^{2} e_{lp}^2\left(80 + 20m - \frac{p_m}{2} + i + j\right) + \sum_{j=-2}^{2} e_{lp}^2\left(80 + 20m + \frac{p_m}{2} + i + j\right) \quad -10 \le i \le 10. \tag{38}$$

The center offset resulting in the smallest energy sum determines the PW. If $i_{mm}(m)$ is the center offset at which the segment end energy is minimized, i.e., $$E_{end}(i_{min}(m)) \leqq E_{end}(i) - 10 \leqq i \leqq 10, \tag{39}$$

the time-domain PW vector for the $m^{th}$ subframe is $$\left\{e_{lp}\left(80+20m-\frac{p_m}{2}+i_{min}(m)+n\right),\ 0\le n<p_m\right\}.$$

This is transformed by a $p_m$-point discrete Fourier transform (DFT) into a complex valued frequency-domain PW vector:

$$P'_m(k)=\sum_{n=0}^{p_m-1} e_{lp}\left(80+20m-\frac{p_m}{2}+i_{min}(m)+n\right)e^{-j\omega_m kn}\quad 0\le k\le K_m. \tag{40}$$

Here $\omega_m$ is the radian pitch frequency and $K_m$ is the highest in-band harmonic index for the $m^{th}$ subframe (see equation 17). The frequency domain PW is used in all subsequent operations in the encoder. The above PW extraction process is carried out for each of the 8 subframes within the current frame, so that the residual signal in the current frame is characterized by the complex PW vector sequence $\{P'_m(k),\ 0\leqq k\leqq K_m,\ 1\leqq m\leqq 8\}$. In addition, an approximate PW is computed for subframe 1 of the look ahead frame, to facilitate a 3-point smoothing of PW gain and magnitude. Since the pitch period is not available for the look-ahead part of the buffer, the pitch period at the end of the current frame, i.e., $p_8$, is used in extracting this PW. The region of the residual used to extract this extra PW is $$\left\{e_{lp}(260+n),\ -\frac{p_8}{2}-12\le n\le\frac{p_8}{2}+12\right\}. \tag{41}$$

By minimizing the end energy sum as before, the time-domain PW vector is obtained as $$\left\{e_{lp}\left(260-\frac{p_8}{2}+i_{min}(9)+n\right),\ 0\le n<p_8\right\}.$$

The frequency-domain PW vector is designated by $P_9$ and is computed by the following DFT:

$$P'_9(k)=\sum_{n=0}^{p_8-1} e_{lp}\left(260-\frac{p_8}{2}+i_{min}(9)+n\right)e^{-j\omega_8 kn}\quad 0\le k\le K_8. \tag{42}$$

It should be noted that the approximate PW is only used for smoothing operations and not as the PW for subframe 1 during the encoding of the next frame. Rather, it is replaced by the exact PW computed during the next frame.

Each complex PW vector can be further decomposed into a scalar gain component representing the level of the PW vector and a normalized complex PW vector representing the shape of the PW vector. Such a decomposition, permits vector quantization that is efficient in terms of computation and storage with minimal degradation in quantization performance. The PW gain is the root-mean square (RMS) value of the complex PW vector. It is obtained by $$g'_{pw}(m)=\sqrt{\frac{1}{2K_m+2}\sum_{k=0}^{K_m}|P'_m(k)|^2}\quad 1\le m\le 8. \tag{43}$$

PW gain is also computed for the extra PW by $$g'_{pw}(9)=\sqrt{\frac{1}{2K_8+2}\sum_{k=0}^{K_8}|P'_9(k)|^2}\ . \tag{44}$$

A normalized PW vector sequence is obtained by dividing the PW vectors by the corresponding gains:

$$P_m(k)=\frac{P'_m(k)}{g'_{pw}(m)}\quad 0\le k\le K_m,\ 1\le m\le 8. \tag{45}$$

And for the extra PW:

$$P_9(k)=\frac{P'_9(k)}{g'_{pw}(9)}\quad 0\le k\le K_8, \tag{46}$$

For a majority of frames, especially during stationary intervals, gain values change slowly from one subframe to the next. This makes it possible to decimate the gain sequence by a factor of about 2, thereby reducing the number of values that need to be quantized. Prior to decimation, the gain sequence is smoothed by a 3-point window, to eliminate excessive variations across the frame. The smoothing operation is in the logarithmic gain domain and is represented by $$g''_{pw}(m)=0.3\ \log_{10} g'_{pw}(m-1)+0.4\ \log_{10} g'_{pw}(m)+0.3\ \log_{10} g'_{pw}(m+1)\quad 1\leqq m\leqq 8. \tag{47}$$

Conversion to logarithmic domain is advantageous since it corresponds to the scale of loudness of sound perceived by the human ear. The smoothed gain values are transformed by the following transformation:

$$g_{pw}(m)=\begin{cases}0 & g''_{pw}(m)>4.5,\\ 90-20\ g''_{pw}(m) & 0\le g''_{pw}(m)\le 4.5,\ 1\le m\le 8\\ 90 & g''_{pw}(m)<0.\end{cases} \tag{48}$$

This transformation limits extreme (very low or very high) values of the gain and thereby improves quantizer performance, especially for low-level signals. The transformed gains are decimated by a factor of 2, requiring that only the even indexed values, i.e., $\{g_{pw}(2), g_{pw}(4), g_{pw}(6), g_{pw}(8)\}$, are quantized.

At the decoder 100B, the odd indexed values are obtained by linearly interpolating between the inverse quantized even indexed values.

A 256 level, 4-dimensional vector quantizer is used to quantize the above gain vector. The design of the vector quantizer is one of the novel aspects of this algorithm. The PW gain sequence can exhibit two distinct modes of behavior. During stationary signals, such as voiced intervals, variations of the gain sequence across a frame are small.

On the other hand, during non-stationary signals such as voicing onsets, the gain sequence can exhibit large variations across a frame. The vector quantizer used must be able to represent both types of behavior. On the average, stationary frames far outnumber the non-stationary frames.

If a vector quantizer is trained using a database, which does not distinguish between the two types, the training is dominated by stationary frames leading to poor performance for non-stationary frames. To overcome this problem, the vector quantizer design was modified by classifying the PW gain vectors classified into a stationary class and a non-stationary class.

For the 256 level codebook, 192 levels were allocated to represent stationary frames and the remaining 64 were allocated for non-stationary frames. The 192 level codebook is trained using the stationary frames, and the 64 level codebook is trained using the non-stationary frames. The training algorithm with a binary split and random perturbation is based on the generalized Lloyd algorithm disclosed in "An algorithm for Vector Quantization Design", by Y. Linde, A. Buzo and R. Gray, pages 84–95 of IEEE Transactions on Communications, VOL. COM-28, No. 1, January 1980 which is incorporated by reference in its entirety. In the case of the stationary codebook, a ternary split is used to derive the 192 level codebook from a 64 level codebook in the final stage of the training process. The 192 level codebook and the 64 level codebook are concatenated to obtain the 256-level gain codebook. The stationary/non-stationary classification is used only during the training phase. During quantization, stationary/non-stationary classification is not performed. Instead, the entire 256-level codebook is searched to locate the optimal quantized gain vector. The quantizer uses a mean squared error (MSE) distortion metric:

$$D_g(l) = \sum_{m=1}^{4} [g_{pw}(2m) - V_g(l, m)]^2 \quad 0 \le l \le 255, \tag{49}$$

where, $\{V_g(l,m), 0 \leqq l \leqq 255, 1 \leqq m \leqq 4\}$ is the 256 level, 4-dimensional gain codebook and $D_g(1)$ is the MSE distortion for the $l^{th}$ codevector. In another embodiment of the present invention the optimal codevector $\{V_g(l^*_g, m), 1 \leqq m \leqq 4\}$ is the one which minimizes the distortion measure over the entire codebook, i.e., $$D_g(l^*_g) \leqq D_g(l) 0 \leqq l \leqq 255. \tag{50}$$

The 8-bit index of the optimal code-vector $l^*_g$ is transmitted to the decoder as the gain index.

Figure 5:
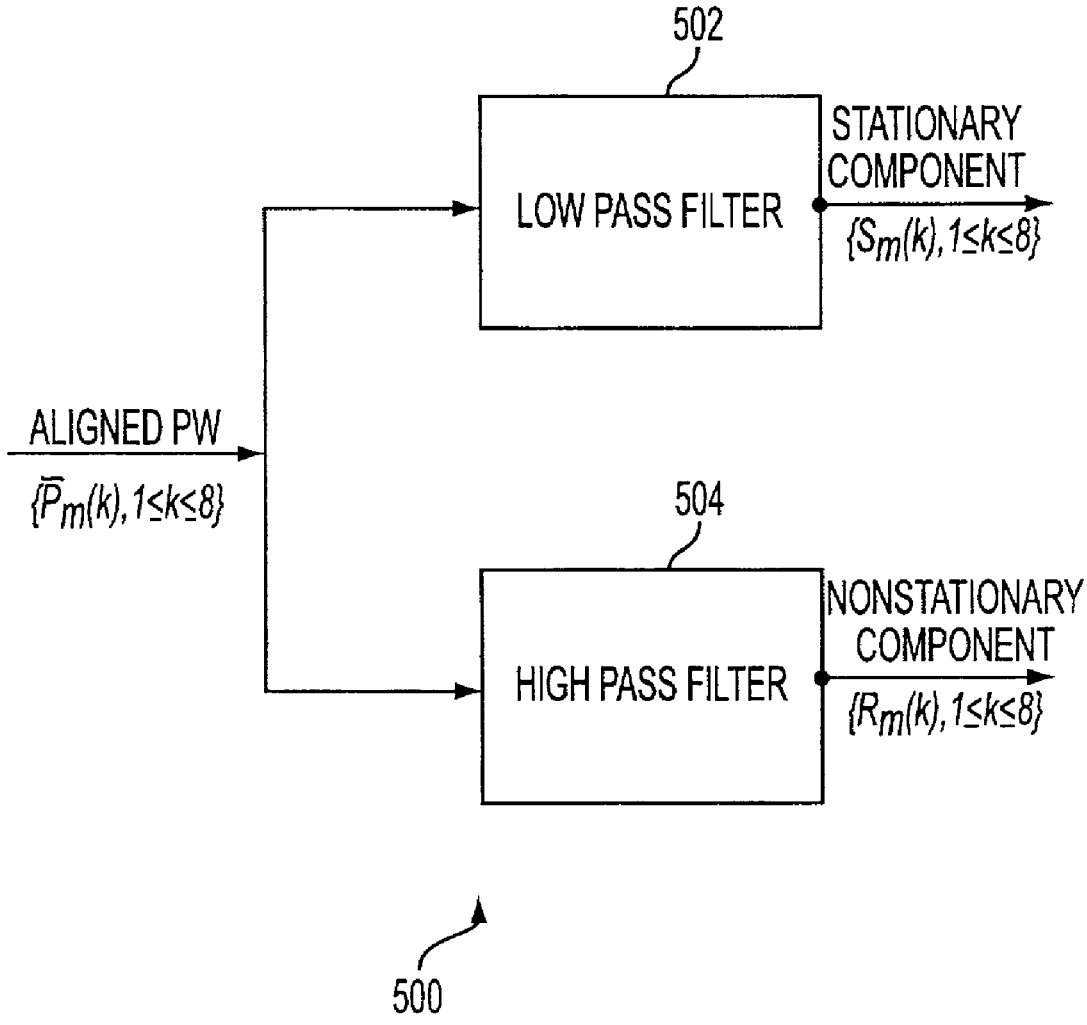
FIG. 5 is a block diagram of stationary and nonstationary components of a prototype waveform (PW) in accordance with an embodiment of the present invention.

FIG. 5 is a block diagram showing the separation of stationary and nonstationary components of a PW in accordance with an embodiment of the present invention and occurs in compute subband nonstationary measure module 116. In the FDI algorithm, only the PW magnitude information is explicitly encoded. PW Phase is not encoded explicitly since the replication of phase spectrum is not necessary for achieving a natural quality in reconstructed speech. However, this does not imply that an arbitrary phase spectrum can be employed at the decoder. One important requirement on the phase spectrum used at the decoder 100B is that it produces the correct degree of periodicity i.e., pitch cycle stationarity across the frequency band. Achieving the correct degree of periodicity is extremely important to reproduce natural sounding speech.

The generation of the phase spectrum at the decoder 100B is facilitated by measuring pitch cycle stationarity at the encoder as a ratio of the energy of the non-stationary component to that of the stationary component in the PW sequence. Further, this energy ratio is measured over 5 subbands spanning the frequency band of interest, resulting in a 5-dimensional vector nonstationarity measure in each frame. This vector is quantized and transmitted to the decoder, where it is used to generate phase spectra that lead to the correct degree of periodicity across the band. The first step in measuring the stationarity of PW is to align the PW sequence.

In order to measure the degree of stationarity of the PW sequence, it is necessary to align each PW to the preceding PW. The alignment process applies a circular shift to the pitch cycle to remove apparent differences in adjacent PWs that are due to temporal shifts or variations in pitch frequency. Let $P_{m-1}$ denote the aligned PW corresponding to subframe m-1 and let $\theta_{m-1}$ be the phase shift that was applied to $P_{m-1}$ to derive $P_{m-1}$. In other words, $$P_{m-1}(k) = P_{m-1}(k) e^{j\theta_{m-1}} k 0 \leqq k \leqq K_{m-1}. \tag{51}$$

For the alignment of $P_m$ to $P_{m-1}$, if the residual signal is perfectly periodic with the pitch period being an integer number of samples, $P_m$ and $P_{m-1}$ are identical except for a circular shift. In this case, the pitch cycle for the $m^{th}$ subframe is identical to the pitch cycle for the m-$1^{th}$ subframe, except that the starting point for the former is at a later point in the pitch cycle compared to the latter. The difference in starting point arises due to the advance by a subframe interval and differences in center offsets at subframes m and m-1. With the subframe interval of 20 samples and with center offsets of $i_{min}(m)$ and $i_{min}(m-1)$, it can be seen that the $m^{th}$ pitch cycle is ahead of the m-$1^{th}$ pitch cycle by $20+i_{min}(m)-i_{min}(m-1)$ samples. If the pitch frequency is $\omega_m$, a phase shift of $-\omega_m(20+i_{min}(m)-i_{min}(m-1))$ is necessary to correct for this phase difference and align $P_m$ with $P_{m-1}$. In addition, since $P_{m-1}$ has been circularly shifted by $\theta_{m-1}$ to derive $P_{m-1}$, it follows that the phase shift needed to align $P_m$ with $P_{m-1}$ is a sum of these two phase shifts and is given by $$\theta^{m-1} - \omega_m(20+i_{min}(m)-i_{min}(m-1)). \tag{52}$$

In practice, the residual signal is not perfectly periodic and the pitch period can be non-integer valued. In such a case, the above cannot be used as the phase shift for optimal alignment. However, for quasi-periodic signals, the above phase angle can be used as a nominal shift and a small range of angles around this nominal shift angle are evaluated to find a locally optimal shift angle. Satisfactory results have been obtained with about an angle range of $\pm 0.2\pi$ centered around the nominal shift angle, searched in steps of about $0.04\pi$. For each shift within this range, the shifted version of $P_m$ is correlated against $P_{m-1}$. The shift angle that results in the maximum correlation is selected as the locally optimal shift. This correlation maximization can be represented by $$\underset{-5 \le i \le 5}{\mathrm{MAX}} \sum_{k=0}^{K_m} \mathrm{Re}\left[\tilde{P}_{m-1}(k) P^*_m(k) e^{-j(\tilde{\theta}_{m-1} - \omega_m(20+i_{min}(m)-i_{min}(m-1))+0.04\pi i)k}\right]$$

where * represents complex conjugation and Re[ ] is the real part of a complex vector. If $i=i_{max}$ maximizes the above correlation, then the locally optimal shift angle is $$\theta_m = \theta_{m-1} - \omega_m(20+i_{min}(m)-i_{min}(m-1)) + 0.04\,\pi i_{max} \tag{54}$$

and the aligned PW for the $m^{th}$ subframe is obtained from $$P_m(k) = P_m(k) e^{j\tilde{\theta}_m} k 0 \leqq k \leqq K_m. \tag{55}$$

The process of alignment results in a sequence of aligned PWs from which any apparent dissimilarities due to shifts in the PW extraction window, pitch period etc. have been removed. Only dissimilarities due to the shape of the pitch cycle or equivalently the residual spectral characteristics are preserved. Thus, the sequence of aligned PWs provides a means of measuring the degree of change taking place in the residual spectral characteristics i.e., the degree of stationarity of the residual spectral characteristics. The basic premise of the FDI algorithm is that it is important to encode and reproduce the degree of stationarity of the residual in order to produce natural sounding speech at the decoder. Consider the temporal sequence of aligned PWs along the $k^{th}$ harmonic track, i.e., $$\{P_m(k), 1 \leqq m \leqq 8\}. \tag{56}$$

If the signal is perfectly periodic, the $k^{th}$ harmonic is identical for all subframes, and the above sequence is a constant as a function of m. If the signal is quasi-periodic, the sequence exhibits slow variations across the frame, but is still a predominantly low frequency waveform. It should be noted that here frequency refers to evolutionary frequency, related to the rate at which PW changes across a frame. This is in contrast to harmonic frequency, which is the frequency of the pitch harmonic. Thus, a high frequency harmonic component changing slowly across the frame is said to have low evolutionary frequency content. Or a low frequency harmonic component changing rapidly across the frame is said to have high evolutionary frequency content.

As the signal periodicity decreases, variations in the above PW sequence increase, with decreasing energy at lower frequencies and increasing energy at higher frequencies. At the other extreme, if the signal is aperiodic, the PW sequence exhibits large variations across the frame, with a near uniform energy distribution across frequency. Thus, by determining the spectral energy distribution of aligned PW sequences along a harmonic track, it is possible to obtain a measure of the periodicity of the signal at that harmonic frequency. By repeating this analysis at all the harmonics within the band of interest, a frequency dependent measure of periodicity can be constructed.

The relative distribution of spectral energy of variations of PW between low and high frequencies can be determined by passing the aligned PW sequence along each harmonic track through a low pass filter and a high pass filter. In an embodiment of the present invention, the low pass filter used is a $3^{rd}$ order chebyshev filter with a 3 dB cutoff at 35 Hz (for the PW sampling frequency of 400 Hz), with the following transfer function:

$$H_{lpf2}(z) = \frac{0.063536 - 0.039167z^{-1} - 0.039167z^{-2} + 0.063536z^{-3}}{1 - 2.2255z^{-1} + 1.7265z^{-2} + 0.45231z^{-3}}. \tag{57}$$

The high pass filter used is also a $3^{rd}$ order chebyshev filter with a 3 dB cutoff at 18 Hz with the following transfer function:

$$H_{hpf2}(z) = \frac{0.71923 - 2.1146z^{-1} - 2.1146z^{-2} + 0.71923z^{-3}}{1 - 2.2963z^{-1} + 1.8542z^{-2} + 5.1726z^{-3}}. \tag{58}$$

The output of the low pass filter is the stationary component of the PW that gives rise to pitch cycle periodicity and is denoted by $\{S_m(k), 0 \leqq k \leqq K_m, 1 \leqq m \leqq 8\}$. The output of the high pass filter is the nonstationary component of PW that gives rise to pitch cycle aperiodicity and is denoted by $\{R_m(k), 0 \leqq k \leqq K_m, 1 \leqq m \leqq 8\}$. The energies of these components are computed in subbands and then averaged across the frame.

The harmonics of the stationary and nonstationary components are grouped into 5 subbands spanning the frequency band of interest where the band-edges in Hz is defined by the array $$B_{rs} = [1\ 400\ 800\ 1600\ 2400\ 3400]. \tag{59}$$

The subband edges in Hz can be translated to subband edges in terms of harmonic indices such that the $i^{th}$ subband contains harmonics with indices $\{\eta_m(i-1) \leqq k < \eta_m(i), 1 \leqq i \leqq 5\}$ as follows:

$$\eta_m(i) = \begin{cases} 2 + \left\lfloor \frac{B_{rs}(i)K_m}{4000} \right\rfloor & \left\{1 + \left\lfloor \frac{B_{rs}(i)K_m}{4000} \right\rfloor\right\} < \frac{B_{rs}(i)\pi}{4000\omega_m}, \\ \left\lfloor \frac{B_{rs}(i)K_m}{4000} \right\rfloor & \left\lfloor \frac{B_{rs}(i)K_m}{4000} \right\rfloor > \frac{B_{rs}(i)\pi}{4000\omega_m}, \\ 1 + \left\lfloor \frac{B_{rs}(i)K_m}{4000} \right\rfloor & \text{otherwise.} \end{cases},$$

$$0 \le i \le 5,\ 1 \le m \le$$

The energy in each subband is computed by averaging the squared magnitude of each harmonic within the subband. For the stationary component, the subband energy distribution for the $m^{th}$ subframe is computed by $$ES_m(l) = \frac{1}{2(\eta_m(l) - \eta_m(l-1))} \sum_{k=\eta_m(l-1)}^{\eta_m(l)-1} |S_m(k)|^2 \quad 1 \le l \le 5. \tag{61}$$

For the nonstationary component, the subband energy distribution for the $m^{th}$ subframe is computed by $$ER_m(l) = \frac{1}{2(\eta_m(l) - \eta_m(l-1))} \sum_{k=\eta_m(l-1)}^{\eta_m(l)-1} |R_m(k)|^2 \quad 1 \le l \le 5. \tag{62}$$

Next, these subframe energies are averaged across the frame:

$$ES_{avg}(l) = \frac{1}{8}\sum_{m=1}^{8} ES_m(l), \quad 1 \le l \le 5. \tag{63}$$

$$ER_{avg}(l) = \frac{1}{8}\sum_{m=1}^{8} ER_m(l), \quad 1 \le l \le 5. \tag{64}$$

The subband nonstationarity measure is computed as the ratio of the energy of the nonstationary component to that of the stationary component in each subband:

$$\Re(l) = \frac{ER_{avg}(l)}{ES_{avg}(l)}, \quad 1 \le l \le 5. \tag{65}$$

If this ratio is very low, it indicates that the PW sequence has much higher energy at low evolutionary frequencies than at high evolutionary frequencies, corresponding to a predominantly periodic signal or stationary PW sequence. On the other hand, if this ratio is very high, it indicates that the PW sequence has much higher energy at high evolutionary frequencies than at low evolutionary frequencies, corresponding to a predominantly aperiodic signal or non-stationary PW sequence. Intermediate values of the ratio indicate different mixtures of periodic and aperiodic components in the signal or different degrees of stationarity of the PW sequence. This information can be used at the decoder to create the correct degree of variation from one PW to the next, as a function of frequency and thereby realize the correct degree of periodicity in the signal.

In case of nonstationary voiced signals, where the pitch cycle is changing rapidly across the frame, the nonstationarity measure may have high values even in low frequency bands. This is usually a characteristic of unvoiced signals and usually translates to a noise-like excitation at the decoder. However, it is important that non-stationary voiced frames are reconstructed at the decoder with glottal pulse-like excitation rather than with noise-like excitation. This information is conveyed by a scalar parameter called a voicing measure, which is a measure of the degree of voicing of the frame. During stationary voiced and unvoiced frames, there is some correlation between the nonstationarity measure and the voicing measure. However, while the voicing measure indicates if the excitation pulse should be a glottal pulse or a noise-like waveform, the nonstationarity measure indicates how much this excitation pulse should change from subframe to subframe. The correlation between the voicing measure and the nonstationarity measure is exploited by vector quantizing these jointly.

The voicing measure is estimated for each frame based on certain characteristics correlated with the voiced/unvoiced nature of the frame. It is a heuristic measure that assigns a degree of voicing to each frame in the range 0–1, with a zero indicating a perfectly voiced frame and a one indicating a completely unvoiced frame.

The voicing measure is determined based on six measured characteristics of the current frame which are, the average of the nonstationarity measure in the 3 low frequency subbands, a relative signal power which is computed as the difference between the signal power of the current frame and a long term average signal power, the pitch gain, the average correlation between adjacent aligned PWs, the $1^{st}$ reflection coefficient obtained during LP Analysis, and the variance of the candidate pitch lags computed during pitch estimation.

The (squared) normalized correlation between the aligned PW of the $m^{th}$ and $m-1^{th}$ frames is obtained by $$\gamma_m = \frac{\left[\sum_{k=1}^{6} \tilde{P}_m(k)\tilde{P}_{m-1}(k)\right]^2}{\sum_{k=1}^{6} \left|\tilde{P}_m(k)\right|^2 \sum_{k=1}^{6} \left|\tilde{P}_{m-1}(k)\right|^2}. \tag{66}$$

It should be noted that the upper limit of the summations are limited to 6 rather than $K_m$ to reduce computational complexity. This subframe correlation is averaged across the frame to obtain an average PW correlation:

$$\gamma_{avg} = \frac{1}{8}\sum_{m=1}^{8} \gamma_m. \tag{67}$$

The average PW correlation is a measure of pitch cycle to pitch cycle correlation after variations due to signal level, pitch period and PW extraction offset have been removed. It exhibits a strong correlation to the nature of glottal excitation. As mentioned earlier, the nonstationarity measure, especially in the low frequency subbands, has a strong correlation to the voicing of the frame. An average of the nonstationarity measure for the 3 lowest subbands provides a useful parameter in inferring the nature of the glottal excitation. This average is computed as $$\Re_{avg} = \frac{1}{3}\sum_{l=1}^{3} \Re_l. \tag{68}$$

It will be appreciated by those skilled in the art that subbands other than the three lowest subbands can be used without departing from the scope of the present invention.

The pitch gain is a parameter that is computed as part of the pitch analysis function. It is essentially the value of the peak of the autocorrelation function (ACF) of the residual signal at the pitch lag. To avoid spurious peaks, the ACF used in the embodiment of this invention is a composite autocorrelation function, computed as a weighted average of adjacent residual raw autocorrelation functions.

The pitch gain, denoted by $\beta_{pitch}$ is the value of the peak of a composite autocorrelation function. The composite ACF are evaluated once every 40 samples within each frame at 80, 120, 160, 200 and 240 samples as shown in FIG. 2. For each of the 5 ACF, the location of the peak ACF is selected as a candidate pitch period. The variation among these 5 candidate pitch lags is also a measure of the voicing of the frame. For unvoiced frames, these vales exhibit a higher variance than for voiced frames. The mean is computed as $$\text{p_cand}_{avg} = \frac{1}{5}\sum_{l=0}^{4} \text{p_cand}_l. \tag{69}$$

The variation is computed by the average of the absolute deviations from this mean:

$$p_{\text{var}} = \frac{1}{5}\sum_{l=0}^{4} |\text{p_cand}_{avg} - \text{p_cand}_l|. \tag{70}$$

This parameter exhibits a moderate degree of correlation to the voicing of the signal.

The signal power also exhibits a moderate degree of correlation to the voicing of the signal. However, it is important to use a relative signal power rather than an absolute signal power, to achieve robustness to input signal level deviations from nominal values. The signal power in dB is defined as $$E_{sig} = 10\log_{10}\left[\frac{1}{160}\sum_{n=80}^{239} s^2(n)\right]. \tag{71}$$

An average signal power can be obtained by exponentially averaging the signal power during active frames. Such an average can be computed recursively using the following equation:

$$E_{sigavg}=0.95E_{sigavg}+0.05E_{sig}. \tag{72}$$

A relative signal power can be obtained as the difference between the signal power and the average signal power:

$$E_{sigrel}=E_{sig}-E_{sigavg}. \tag{73}$$

The relative signal power measures the signal power of the frame relative a long term average. Voiced frames exhibit moderate to high values of relative signal power, whereas unvoiced frames exhibit low values.

The $1^{st}$ reflection coeffient $\rho_1$ is obtained as a byproduct of LP analysis during Levinson-Durbin recursion. Conceptually it is equalivalent to the $1^{st}$ order normalized autocorrelation coefficient of the noise reduced speech. During voiced speech segments, the speech spectrum tends to have a low pass characteristic, which results in a $\rho_1$ close to 1. During unvoiced frames, the speech spectrum tends to have a flatter or high pass characteristic, resulting in smaller or even negative values for $\rho_1$.

To derive the voicing measure, each of these six parameters are nonlinearly transformed using sigmoidal functions such that they map to the range 0–1, close to 0 for voiced frames and close to 1 for unvoiced frames. The parameters for the sigmoidal transformation have been selected based on an analysis of the distribution of these parameters. The following are the transformations for each of these parameters:

$$n_{pg} = 1 - \frac{1}{\left(1 + e^{-12(\beta_{pitch}-0.48)}\right)} \tag{74}$$

$$n_{pw} = \begin{cases} 1 - \dfrac{1}{(1 + e^{-10(\gamma_{avg}-0.72)})} & \gamma_{avg} \le 0.72 \\ 1 - \dfrac{1}{(1 + e^{-13(\gamma_{avg}-0.72)})} & \gamma_{avg} > 0.72 \end{cases} \tag{75}$$

$$n_{\Re} = \begin{cases} \dfrac{1}{\left(1 + e^{-7(\Re_{avg}-0.85)}\right)} & \Re_{avg} \le 0.85 \\ \dfrac{1}{\left(1 + e^{-3(\Re_{avg}-0.72)}\right)} & \Re_{avg} > 0.85 \end{cases} \tag{76}$$

$$n_E = 1 - \frac{1}{\left(1 + e^{-1.25(E_{sigrel}-2)}\right)} \tag{77}$$

$$n_{pv} = \begin{cases} 0.5 - 12.5(p_{var} - 0.02) & p_{var} < 0.02 \\ 10(0.07 - p_{var}) & p_{var} < 0.07 \\ 1 & p_{var} \ge 0.07 \end{cases} \tag{78}$$

$$n_\rho = \begin{cases} 1 - \dfrac{1}{(1 + e^{-5(\rho_1-0.85)})} & \rho_1 \le 0.85 \\ 1 - \dfrac{1}{(1 + e^{-13(\rho_1-0.85)})} & \rho_1 > 0.85 \end{cases}$$

The voicing measure of the previous frame $v_{prev}$ determines the weighted sum of the transformed parameters which results in the voicing measure:

$$v = \begin{cases} 0.35n_{pg} + 0.225n_{pw} + 0.15n_{\Re} + 0.085n_E + 0.07n_{pv} + 0.12n_\rho & v_{prev} < 0.3 \\ 0.35n_{pg} + 0.2n_{pw} + 0.1n_{\Re} + 0.1n_E + 0.05n_{pv} + 0.2n_\rho & v_{prev} \ge 0.3. \end{cases} \tag{79}$$

The weights used in the above sum are in accordence with the degree of correlation of the parameter to the voicing of the signal. Thus, the pitch gain receives the highest weight since it is most strongly correlated, followed by the PW correlation. The $1^{st}$ reflection coefficient and low-band nonstationarity measure receive moderate weights. The weights also depend on whether the previous frame was strongly voiced, in which case more weight is given to the low-band nonstationarity measure. The pitch variation and relative signal power receive smaller weights since they are only moderately correlated to voicing.

If the resulting voicing measure v is clearly in the voiced region (v<0.45) or clearly in the unvoiced region (v>0.6), it is not modified further. However, if it lies outside the clearly voiced or unvoiced regions, the parameters are examined to determined if there is a moderate bias towards a voiced frame. In such a case, the voicing measure is modified so that its value lies in the voiced region.

The resulting voicing measure ν takes on values in the range 0–1, with lower values for more voiced signals. In addition, a binary voicing measure flag is derived from the voicing measure as follows:

$$v_{flag} = \begin{cases} 0 & v \le 0.45, \\ 1 & v > 0.45, \end{cases} \tag{80}$$

Thus, $v_{flag}$ is 0 for voiced signals and 1 for unvoiced signals. This flag is used in selecting the quantization mode for PW magnitude and the subband nonstationarity vector. The voicing measure ν is concatenated to the subband nonstationarity measure vector and the resulting 6-dimensional vector is vector quantized.

The subband nonstationarity measure can have occasional spurious large values, mainly due to the approximations and the averaging used during its computation. If this occurs during voiced frames, the signal is reproduced with excessive roughness and the voice quality is degraded. To prevent this, large values of the nonstationarity measure are attenuated. The attenuation charactersitic has been determined experimentally and is specified as follows for each of the five subbands:

Additionaly, for voiced frames, it is necessary to ensure that the values of the nonstationarity measure in the low frequency subbands are in a monotonically nondecreasing order. This condition is enforced for the 3 lower subbands according to the flow chart in FIG. 6.

Figure 6:
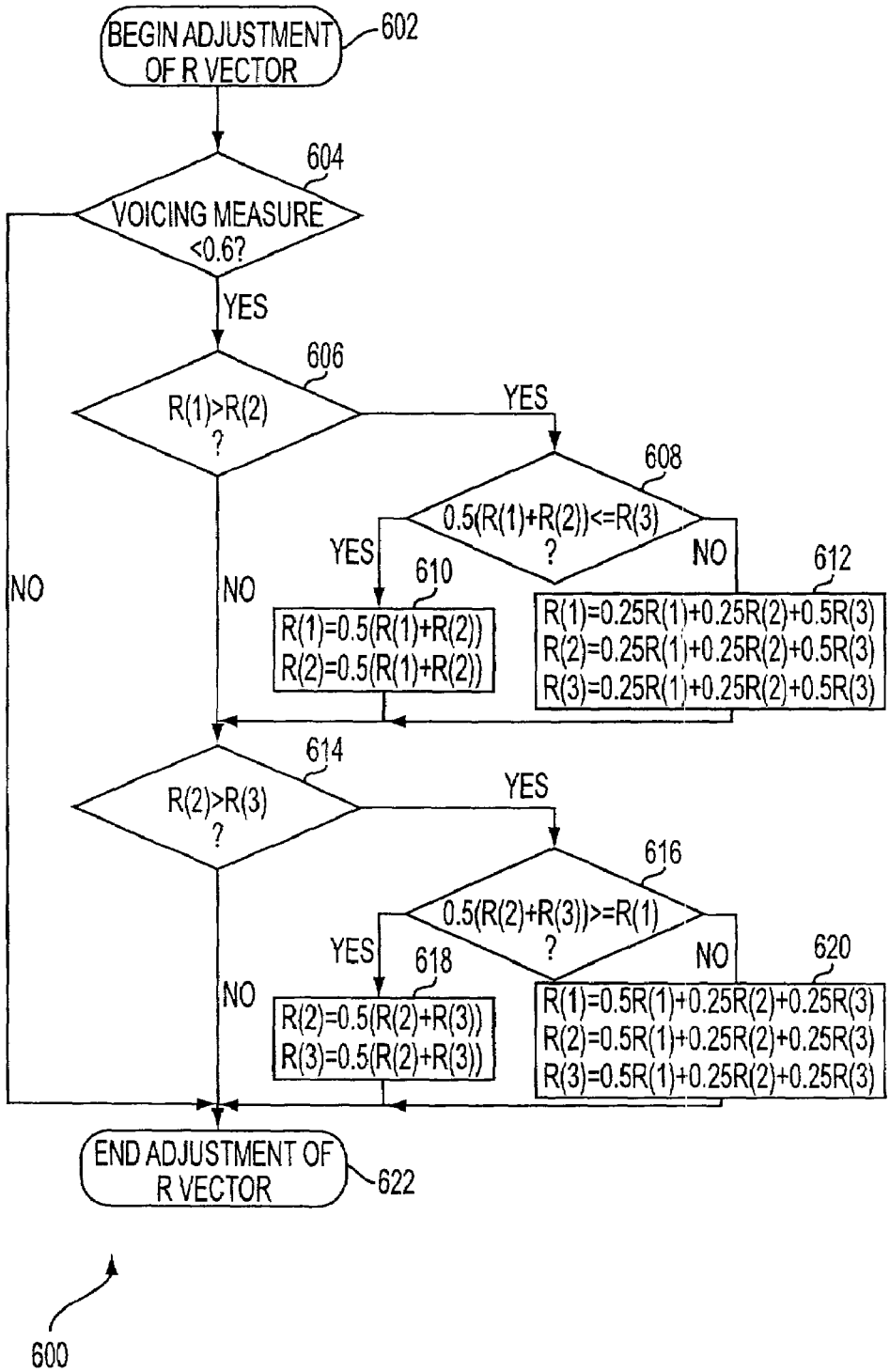
FIG. 6 is a flow chart for a method for enforcing monotonic measures in accordance with an embodiment of the present invention.

FIG. 6 is a flow chart depicting a method 600 for enforcing monotonic measures in accordance with an embodiment of the present invention. The method 600 occurs in compute subband nonstationary measure module 116 and is initiated at step 602 where the adjustment for the R vector is begun. The method 600 then proceeds to step 604.

At step 604 a determination is made as to whether the voicing measure is less than 0.6. If the determination is answered negatively, the method proceeds to step 622. If the determination is answered affirmatively the method proceeds to step 606.

At step 606 a determination is made as to whether R1 is greater than R2. If the determination is answered negatively, the method proceeds to step 614. If the determination is answered affirmatively, the method proceeds to step 608.

At step 614 a determination is made as to whether R2 is greater than R3. If the determination is answered negatively the method proceeds to step 622. If the determination is answered affirmatively, the method proceeds to step 616.

At step 608 a determination is made as to whether 0.5(R1+R2) is less than or equal to R3. If the determination $$\Re(1) \Leftarrow \begin{cases} \Re(1) & v > 0.6 \text{ or } \Re(1) \le 0.3 + 0.1667v \\ 0.05 + 0.1667v + \dfrac{0.5}{\left(1 + e^{-5(\Re(1) - 0.3 - 01667v)}\right)} & v \le 0.6 \text{ and } \Re(1) > 0.3 + 0.1667v \end{cases} \tag{81}$$

$$\Re(2) \Leftarrow \begin{cases} \Re(2) & v > 0.6 \text{ or } \Re(2) \le 0.45 + 0.1667v \\ 0.2 + 0.0833v + \dfrac{0.5 + 0.1667v}{\left(1 + e^{-5(\Re(2) - 045 - 0.1667v)}\right)} & v \le 0.6 \text{ and } \Re(2) > 0.45 + 0.1667v \end{cases} \tag{82}$$

$$\Re(3) \Leftarrow \begin{cases} \Re(3) & v > 0.6 \text{ or } \Re(3) \le 0.5 + 0.5v \\ 0.1 + 0.5v \dfrac{0.8}{\left(1 + e^{-5(\Re(3) - 05 - 0.5v)}\right)} & v \le 0.6 \text{ and } \Re(3) > 0.5 + 0.5v \end{cases} \tag{83}$$

$$\Re(4) \Leftarrow \begin{cases} \Re(4) & v > 0.6 \text{ or } \Re(4) \le 0.65 + 0.5833v \\ 0.3 + 0.3333v \dfrac{0.7 + 0.5v}{\left(1 + e^{-5(\Re(4) - 0.3 - 03333v)}\right)} & v \le 0.6 \text{ and } \Re(4) > 0.65 + 0.5833v \end{cases} \tag{84}$$

$$\Re(5) \Leftarrow \begin{cases} \Re(5) & v > 0.6 \text{ or } \Re(5) \le 0.65 + 0.5833v \\ 0.3 + 0.3333v \dfrac{0.7 + 0.5v}{\left(1 + e^{-5(\Re(5) - 0.3 - 03333v)}\right)} & v \le 0.6 \text{ and } \Re(5) > 0.65 + 0.5833v \end{cases} \tag{85}$$

is answered affirmatively the method proceeds to step 610 where a formula is used to calculate R1 and R2. The method then proceeds to step 614.

If the determination at step 608 is answered negatively, the method proceeds to step 612 where a series of calculations is used to calculate R1, R2 and R3. The method then proceeds to step 614.

At step 616 a determination is made as to whether 0.5(R1+R3) is greater than or equal to R1. If the determination is answered affirmatively, the method proceeds to step 618 where a series of calculations is used to calculate R2 and R3. If the method is answered negatively, the method proceeds to step 620 where a series of calculations is used to calculate R1, R2 and R3.

The steps 614, 618 and 620 proceed to step 622 where the adjustment of the R vector ends.

The nonstationarity measure vector is vector quantized using a spectrally weighted quantization. The spectral weights are derived from the LPC parameters. First, the LPC spectral estimate corresponding to the end point of the current frame is estimated at the pitch harmonic frequencies. This estimate employs tilt correction and a slight degree of bandwidth broadening. These measures are needed to ensure that the quantization of formant valleys or high frequencies are not compromised by attaching excessive weight to formant regions or low frequencies.

$$W_8(k) = \frac{\left|\sum_{m=0}^{10} a_8'(i)0.4^m e^{-jw_8 k8}\right|^2}{\left|\sum_{m=0}^{10} a_8'(i)0.98^m e^{-jw_8 k8}\right|^2} \quad (86)$$

$$0 \le k \le K_8.$$

This harmonic spectrum is converted to a subband spectrum by averaging across the 5 subbands used for the computation of the nonstationarity measure.

$$\overline{W}_8(l) = \frac{1}{(\eta_8(l) - \eta_8(l-1))} \sum_{k=\eta_8(l-1)}^{\eta_8(l)-1} W_8(k) \quad (87)$$

$$1 \le l \le 5.$$

This is averaged with the subband spectrum at the end of the previous frame to derive a subband spectrum that corresponding to the center of the current frame. This average serves as the spectral weight vector for the quantization of the nonstationarity vector.

$$\overline{W}_4(l)=0.5(\overline{W}_0(1)+\overline{W}8(1)) \quad 1 \le l \le 5. \quad (88)$$

The voicing measure is concatenated to the end of the nonstationarity measure vector, resulting in a 6-dimensional composite vector. This permits the exploitation of the considerable correlation that exists between these quantities. The composite vector is denoted by $$\mathfrak{R}_{\mathrm{nc}}=\{\mathfrak{R}(1)\mathfrak{R}(2)\mathfrak{R}(3\mathfrak{R}(4)\ \mathfrak{R}(5)\theta\}. \quad (89)$$

The spectral weight for the voicing measure is derived from the spectral weight for the nonstationarity measure depending on the voicing measure flag. If the frame is voiced ($\theta_{flag}$=0), the weight is computed as $$\overline{W}_4(6) = \frac{0.33}{5} \sum_{i=1}^{5} W_4(l) \quad v_{flag} = 0. \quad (90)$$

In other words, it is lower than the average weight for the nonstationary component. This ensures that that the nonstationary component is quantized more accurately than the voicing measure. This is desirable since for voiced frames, it is important to preserve the nonstationarity in the various bands to achieve the right degree of periodicty. On the other hand, for unvoiced frames, voicing measure is more important. In this case, its weight is larger than the maximum weight for the nonstationary component.

A 64 level, 6-dimensional vector quantizer is used to quantize the composite nonstationarity measure-voicing measure vector. The first 8 codevectors (indices 0–7) assigned to represent unvoiced frames and the remaining 56 codevectors (indices 8–63) are assigned to respresent voiced frames. The voiced/unvoiced decision is made based on the voicing measure flag. The following weighted MSE distortion measure is used:

$$D_R(l) = \sum_{m=1}^{6} \overline{W}_4(m)[\mathfrak{R}_c(m) - V_R(l, m)]^2 \quad (92)$$

$$0 \le l \le 63,$$

Here, $\{V_R(l,m), 0 \leqq l \leqq 63, 1 \leqq m \leqq 6\}$ is the 64 level, 6-dimensional composite nonstationarity measure-voicing measure codebook and $D_R$ (l) is the weighted MSE distortion for the $1^{th}$ codevector. If the frame is unvoiced ($\theta_{flag}$=1), this distortion is minimized over the indices 0–7. If the frame is voiced ($\theta_{flag}$=0), the distortion is minimized over the indices 8–63. Thus, $$D_R^{\min} = \begin{cases} \underset{0 \le l \le 7}{\mathrm{MIN}} D_R(l) & v_{flag} = 1 \\ \underset{8 \le l \le 63}{\mathrm{MIN}} D_R(l) & v_{flag} = 0 \end{cases} \quad (93)$$

This partitioning of the codebook reflects the higher importance given to the representation of the nonstationarity measure during voiced frames. The 6-bit index of the optimal codevector $1^*_R$ is transmitted to the decoder as the nonstationarity measure index. It should be noted that the voicing measure flag, which is used in the decoder 100B for the inverse quantization of the PW magnitude vector, can be detected by examining the value of this index.

Up to this point, the PW vectors are processed in Cartesian (i.e., real-imaginary) form. The FDI codec 100 at 4.0 kbit/s encodes only the PW magnitude information to make the most efficient use of available bits. PW phase spectra are not encoded explicitly. Further, in order to avoid the computation intensive square-root operation in computing the magnitude of a complex number, the PW magnitude-squared vector is used during the quantization process.

The PW magnitude vector is quantized using a hierarchical approach, which allows the use of fixed dimension VQ with a moderate number of levels and precise quantization of perceptually important components of the magnitude spectrum. In this approach, the PW magnitude is viewed as the sum of two components: a PW mean component, which is obtained by averaging the PW magnitude across frequencies within a 7 band sub-band structure, and a PW deviation component, which is the difference between the PW magnitude and the PW mean. The PW mean component captures the average level of the PW magnitude across frequency, which is important to preserve during encoding. The PW deviation contains the finer structure of the PW magnitude spectrum and is not important at all frequencies. It is only necessary to preserve the PW deviation at a small set of perceptually important frequencies. The remaining elements of PW deviation can be discarded, leading to a small, fixed dimensionality of the PW deviation component.

The PW magnitude vector is quantized differently for voiced and unvoiced frames as determined by the voicing measure flag. Since the quantization index of the nonstationarity measure is determined by the voicing measure flag, the PW magnitude quantization mode information is conveyed without any additional overhead.

During voiced frames, the spectral characteristics of the residual are relatively stationary. Since the PW mean component is almost constant across the frame, it is adequate to transmit it once per frame. The PW deviation is transmitted twice per frame, at the $4^{th}$ and $8^{th}$ subframes. Further, interframe predictive quantization can be used in the voiced mode. On the other hand, unvoiced frames tend to be nonstationary. To track the variations in PW spectra, both mean and deviation components are transmitted twice per frame, at the $4^{th}$ and $8^{th}$ subframes. Prediction is not employed in the unvoiced mode.

The PW magnitude vectors at subframes 4 and 8 are smoothed by a 3-point window. This smoothing can be viewed as an approximate form of decimation filtering to down sample the PW vector from 8 vectors/frame to 2 vectors/frame.

$$\bar{P}_m(k)=0.3P_{m-1}(k)+0.4P_m(k)+0.3P_{m+1}(k),\quad 0\leqq k\leqq K_m,\quad m=4,8. \tag{94}$$

The subband mean vector is computed by averaging the PW magnitude vector across 7 subbands. The subband edges in Hz are $$B_{pw}=[1\ 400\ 800\ 1200\ 1600\ 2000\ 2600\ 3400] \tag{95}$$

To average the PW vector across frequencies, it is necessary to translate the subband edges in Hz to subband edges in terms of harmonic indices. The band-edges in terms of hamonic indices for subframes 4 and 8 can be computed by $$\kappa_m(i)=\begin{cases} 2+\left\lfloor\frac{B_{pw}(i)K_m}{4000}\right\rfloor & \left\{1+\left\lfloor\frac{B_{pw}(i)K_m}{4000}\right\rfloor\right\}<\frac{B_{pw}(i)\pi}{4000\omega_m}, \\ \left\lfloor\frac{B_{pw}(i)K_m}{4000}\right\rfloor & \left\lfloor\frac{B_{pw}(i)K_m}{4000}\right\rfloor>\frac{B_{pw}(i)\pi}{4000\omega_m}, \\ 1+\left\lfloor\frac{B_{pw}(i)K_m}{4000}\right\rfloor & \text{otherwise.} \end{cases}\Bigg\}, \tag{96}$$

$$0\leq i\leq 7,\ m=4,8.$$

The mean vectors are computed at subframes 4 and 8 by averaging over the harmonic indices of each subband. It should be noted that, as mentioned earlier, since the PW vector is available in magnitude-squared form, the mean vector is in reality a RMS vector. This is reflected by the following equation.

$$P_m(i)=\sqrt{\frac{1}{\kappa_m(i+1)-\kappa_m(i)}\sum_{k=\kappa_m(i)}^{\kappa_m(i+1)-1}|P_m(k)|^2},\ 0\leq i\leq 6,\ m=4,8. \tag{97}$$

The mean vector quantization is spectrally weighted. The spectral weight vector is computed for subframe 8 from LP parameters as follows:

$$W_8(k)=\frac{\sum_{l=0}^{10}\alpha_l'(8)(0.4)^l e^{-j\omega_8 kl}}{\sum_{l=0}^{10}\alpha_l'(8)(0.98)^l e^{-j\omega_8 kl}} \tag{98}$$

The spectral weight vector is attenuated outside the band of interest, so that out-of-band PW components do not influence the selection of the optimal code-vector.

$$W_8(k)\leftarrow W_8(k)10^{-10},\ 0\leqq k\leqq \kappa_8(0)\text{ or }\kappa_8(7)\leqq k\leqq K_8. \tag{99}$$

The spectral weight vector for subframe 4 is approximated as an average of the spectral weight vectors of subframes 0 and 8. This approximation is used to reduce computational complexity of the encoder.

$$W_4(k)=0.5(W_0(k)+W_8(k)),0\leqq k\leqq K_4. \tag{100}$$

The spectral weight vectors at subframes 4 and 8 are averaged over subbands to serve as spectral weights for quantizing the subband mean vectors:

$$W_m(i)=\frac{1}{\kappa_m(i+1)-\kappa_m(i)}\sum_{k=\kappa_m(i)}^{\kappa_m(i+1)-1}(k),\ 0\leq i\leq 6,\ m=4,8. \tag{101}$$

The mean vectors at subframes 4 and 8 are vector quantized using a 7 bit codebook. A precomputed DC vector $\{P_{DC_UV}(i),0\leqq i\leqq 6\}$ is subtracted from the mean vectors prior to quantization. The resulting vectors are matched against the codebook using a spectrally weighted MSE distortion measure. The distortion measure is computed as $$D_{\mathrm{PWM_UV}}(m,l)=\sum_{i=0}^{6}\overline{W}_m(i)[V_{\mathrm{PWM_UV}}(l,i)-(\bar{P}_m(i)-P_{\mathrm{DC_UV}}(i))]^2\ 0\leq l\leq 127,\ m=4,8. \tag{102}$$

Here, $\{V_{PWM_UV}(l,i),0\leqq l\leqq 127,0\leqq i\leqq 6\}$ is the 7-dimensional, 128 level unvoiced mean codebook. Let $l^*_{PWM_UV_4}$ and $l^*_{PWM_UV_8}$ be the codebook indices that minimize the above distortion for subframes 4 and 8 respectively, i.e., $$D_{\mathrm{PWM_UV}}(m,l^*_{\mathrm{PWM_UV_m}})=\min_{0\leq l\leq 127}D_{\mathrm{PWM_UV}}(m,l),\ m=4,8. \tag{103}$$

The quantized subband mean vectors are given by adding the optimal codevectors to the DC vector:

$$\bar{P}_{mq}(i)=P_{DC_UV}(i)+V_{PWM_UV}(l^*_{PWM_m},i)\ 0\leqq i\leqq 6,\ m=4,8. \tag{104}$$

The quantized subband mean vectors are used to derive the PW deviations vectors. This makes it possible to compensate for the quantization error in the mean vectors during the quantization of the deviations vectors. Deviations vectors are computed for subframes 4 and 8 by subtracting fullband vectors constructed using quantized mean vectors from original PW magnitude vectors. The fullband vectors are obtained by piecewise-constant approximation across each subband:

$$S_m(k)=\begin{cases}0 & k<\kappa_m(i),\ m=4,8,\\ \bar{P}_{mq}(i), & \kappa_m(i)\le k<\kappa_m(i+1),\ 0\le i\le 6,\ m=4,8,\\ 0 & \kappa_m(7)\le k\le K_m,\ m=4,8.\end{cases} \tag{105}$$

The deviation vector is quantized only for a small subset of the harmonics, which are perceptually important. There are a number of approaches to selecting the harmonics, by taking into account the signal characteristics, spectral energy distribution etc. This embodiment of the present invention uses a simple approach where harmonics 1–10 are selected. This ensures that the low frequency part of the speech spectrum, which is perceptually important is reproduced more accurately. Taking into account the fact that the PW vector is available in magnitude-squared form, harmonics 1–10 of the deviation vector are computed as follows:

$$F_m(k)=\overline{P_m(kstart_m+k)}-S_m(kstart_m+k),\quad 1\leqq k\leqq 10,\ m=4,8 \tag{106}$$

Here, $kstart_m$ is computed so that harmonics below 200 Hz are not selected for computing the deviations vector:

$$kstart_m=\begin{cases}0, & K_m<20,\\ 1, & 20\le K_m<40,\quad m=4,8.\\ 2, & 40\le K_m.\end{cases} \tag{107}$$

The quantization of deviations vectors is carried out by a 6-bit vector quantizer using spectrally weighted MSE distortion measure.

$$D_{PWD_UV}(m,l)=\sum_{k=1}^{10}W_m(k+kstart_m)[V_{PWD_UV}(l,k)-F_m(k)]^2\quad 0\le l\le 63,\ m=4,8. \tag{108}$$

Here, $\{V_{PWD_UV}(l,k),0\leqq l\leqq 63,1\leqq k\leqq 10\}$ is the 10-dimensional, 63 level unvoiced deviations codebook. Let $l^*_{PWD_UV_4}$ and $l^*_{PWD_UV}$ be the codebook indices that minimize the above distortion for subframes 4 and 8 respectively, i.e., $$D_{PWD_UV}(m,l^*_{PWD_UV_m})=\underset{0\le l\le 63}{\mathrm{MIN}}\,D_{PWD_UV}(m,l),\ m=4,8. \tag{109}$$

The quantized deviations vectors are the optimal codevectors:

$$F_{mq}(i)=V_{PWD_UV}(l^*_{PWD_UV_m,k})\ 1\leqq k\leqq 10,m=4,8 \tag{110}$$

The two 7-bit mean quantization indices $l^*_{PWM_UV_4}$, $l^*_{PWM_UV_8}$ and the two 6-bit deviation indices $l^*_{PWD_UV_4}$, $l^*_{PWD_UV_8}$ represent the PW magnitude information for unvoiced frames using a total of 26 bits. In addition, a single bit is used to represent the binary VAD flag during unvoiced frames only.

In the voiced mode, the PW magnitude vector smoothing, the computation of harmonic subband edges and the PW subband mean vector at subframe 8 take place as in the case of unvoiced frames. In contrast to the unvoiced case, a predictive VQ approach is used where the quantized PW subband mean vector at subframe 0 (i.e., subframe 8 of previous frame) is used to predict the PW subband mean vector at subframe 8. A prediction coefficient of 0.5 is used. A predetermined DC vector is subtracted prior to prediction. The resulting vectors are quantized by a 7-bit codebook using a spectrally weighted MSE distortion measure. The subband spectral weight vector is computed for subframe 8 as in the case of unvoiced frames. The distortion computation is summarized by $$D_{PWM_V}(l)=\sum_{i=0}^{6}\bar{W}_8(i)\big[V_{PWM_V}(l,i)-(\bar{P}_8(i)-P_{DC_V}(i))+0.5(\bar{P}_{0q}(i)-P_{DC_V}(i))\big]^2\quad 0\le l\le 127. \tag{111}$$

Here, $\{V_{PWM_V}(l,i),0\leqq l\leqq 127,0\leqq i\leqq 6\}$ is the 7-dimensional, 128 level voiced mean codebook, $\{P_{DC_V}(i),0\leqq i\leqq 6\}$ is the voiced DC vector. $\{\bar{P}_{0q}(i),0\leqq i\leqq 6\}$ is the predictor state vector which is same as the quantized PW subband mean vector at subframe 8 (i.e., $\{P_{8q}(i),0\leqq i\leqq 6\}$) of the previous frame where $l^*_{PWM_V}$ is the codebook index that minimizes the above distortion, i.e., $$D_{PWM_V}(l^*_{PWM_V})=\underset{0\le l\le 127}{\mathrm{MIN}}\,D_{PWM_V}(l). \tag{112}$$

The quantized subband mean vector at subframe 8 is given by adding the optimal code-vector to the predicted vector and the DC vector:

$$\bar{P}_{8q}(i)=\mathrm{MAX}(0.1,P_{DC_V}(i)+0.5(\bar{P}_{0q}(i)-P_{DC_V}(i))+V_{PWM_V}(l^*_{PWM_}i))0\leqq i\leqq 6. \tag{113}$$

Since the mean vector is an average of PW magnitudes, it should be a nonnegative value. This is enforced by the maximization operation in the above equation 113.

A fullband mean vector $\{S_8(k),0\leqq k\leqq K_8\}$ is constructed at subframe 8 using the quantized subband mean vector, as in the unvoiced mode. A subband mean vector is constructed for subframe 4 by linearly interpolating between the quantized subband mean vectors of subframes 0 and 8:

$$\bar{P}_4(i)=0.5(\bar{P}_{0q}(i)+\bar{P}_{8q}(i))0\leqq i\leqq 6. \tag{114}$$

A fullband mean vector $\{S_4(k),0\leqq k\leqq K_4\}$ is constructed at subframe 4 using this interpolated subband mean vector. By subtracting these fullband mean vectors from the corresponding magnitude vectors, deviations vectors $\{F_4(k),1\leqq k\leqq 10\}$ and $\{F_8(k),1\leqq k\leqq 10\}$ are computed at subframes 4 and 8. Note that these deviations vectors are computed only for selected harmonics, i.e., harmonics (kstart$m$+1)–(kstart$m$+10) as in the unvoiced case. The deviations vectors are predictively quantized based on prediction from the quantized deviation vector from 4 subframes ago i.e, subframe 4 is predicted using subframe 0, subframe 8 using subframe 4. A prediction coefficient of 0.55 is preferably used.

The deviations prediction error vectors are quantized using a multi-stage vector quantizer with 2 stages. The $1^{st}$ stage uses a 64-level codebook and the $2^{nd}$ stage uses a 16-level codebook. Another embodiment of the present invention considers only the 8 best candidates from the $1^{st}$ codebook in searching the $2^{nd}$ codebook which is used to reduce complexity. The distortion measures are spectrally weighted. The spectral weight vectors $\{W_4(k), 0 \leqq k \leqq 10\}$, and $\{W_8(k), 0 \leqq k \leqq 10\}$ computed as in the unvoiced case. The $1^{st}$ codebook uses the following distortion to find the 8 codevectors with the smallest distortion:

$$D_{\mathrm{PWD_V1}}(m, l) = \sum_{k=1}^{10} W_m(k + kstart_m)[V_{\mathrm{PWD_VI}}(l, k) - F_m(k) + 0.55F_{(m-4)q}(k)]^2 \quad (115)$$

$$0 \leq l \leq 63, m =$$

where $\{j_{PWD_V_m}(i), 0 \leqq i \leqq 7\}$ is the 8 indices associated with the 8 best codewords. The entire $2^{nd}$ codebook is searched for each of the 8 codevectors from the $1^{st}$ codebook, so as to minimize the distortion between the input vector and the sum of the $1^{st}$ and $2^{nd}$ codebook vectors:

$$\min_{\substack{l_1 \in j_{\mathrm{PWD_V_m}} \\ 0 \leq l_2 \leq 15}} D_{\mathrm{PWD_V}}(m, l) = \sum_{k=1}^{10} W_m(k)[V_{\mathrm{PWD_V1}}(l_1, k) + V_{\mathrm{PWD_V2}}(l_2, k) - F_m(k) + 0.55F_{(m-4)q}(k)]^2 \quad (116)$$

where $l_1 = l^*_{PWD_V1_4}$ and $l_2 = l^*_{PWD_V2_4}$ minimize the above distortion for subframe 4 and $l_1 = l^*_{PWD_V1_8}$ and $l_2 = l^*_{PWD_V2_8}$ minimize the above distortion for subframe 8. Then, the 7-bit mean quantization index $l^*_{PWM_V}$, the 6-bit index $l^*_{PWD_V1_4}$, the 4-bit index $l^*_{PWD_V1_4}$, the 6-bit index $l^*_{PWD_V1_8}$ and the 4-bit index $l^*_{PWD_V1_8}$ together represent the 27 bits of PW magnitude information for voiced frames. It should be noted that voiced frames are implicitly assumed to be active which removes the need for transmitting the VAD flag.

In the unvoiced mode, the VAD flag is explicitly encoded using a binary index $l^*_{VAD_UV}$:

$$l^*_{VAD_UV} = \mathrm{VAD_FLAG} \quad (117)$$

In the voiced mode, it is implicitly assumed that the frame is active speech. Consequently, it is not necessary to explicitly encode the VAD information.

In a preferred embodiment, at 4 kb/s, the following table 1 summarizes the bits allocated to the quantization of the encoder parameters under voiced and unvoiced modes. As indicated in the table, a single parity bit is included as part of the 80 bit compressed speech packet. This bit is intended to detect channel errors in a set of 24 critical (Class 1) bits. Class 1 bits consist of the 6 most significant bits (MSB) of the PW gain bits, 3 MSBs of $1^{st}$ LSF, 3 MSBs of $2^{nd}$ LSF, 3 MSBs of $3^{rd}$ LSF, 2 MSBs of $4^{th}$ LSF, 2 MSBs of $5^{th}$ LSF, MSB of $6^{th}$ LSF, 3 MSBs of the pitch index and MSB of the nonstationarity measure index. The single parity bit is obtained by an exclusive OR operation of the Class 1 bit sequence. It will be appreciated by those skilled in the art that other bit allocations can be used and still fall within the scope of the present invention.

TABLE 1

| | | Voiced Mode | Unvoiced Mode |
|---|---|---|---|
| Pitch | | 7 | 7 |
| LSF Parameters | | 31 | 31 |
| PW Gain | | 8 | 8 |
| Nonstationarity & voicing Measure | | 6 | 6 |
| PW Magnitude | Mean | 7 | 14 |
| | Deviations | 20 | 12 |
| VAD Flag | | 0 | 1 |
| Parity Bit | | 1 | 1 |
| Total/20 ms Frame | | 80 | 80 |

The present invention will now be discussed with reference to decoder 100B. The decoder receives the 80 bit packet of compressed speech produced by the encoder and reconstructs a 20 ms segment of speech. The received bits are unpacked to obtain quantization indices for the LSF parameter vector, the pitch period, the PW gain vector, the nonstationarity measure vector and the PW magnitude vector. A cyclic redundancy check (CRC) flag is set if the frame is marked as a bad frame. For example this could be due to frame erasures or if the parity bit which is part of the 80 bit compressed speech packet is not consistent with the class 1 bits comprising the gain, LSF, pitch and nonstationarity measure bits. Otherwise, the CRC flag is cleared. If the CRC flag is set, the received information is discarded and bad frame masking techniques are employed to approximate the missing information.

Based on the quantization indices, LSF parameters, pitch, PW gain vector, nonstationarity measure vector and the PW magnitude vector are decoded. The LSF vector is converted to LPC parameters and linearly interpolated for each subframe. The pitch frequency is interpolated linearly for each sample. The decoded PW gain vector is linearly interpolated for odd indexed subframes. The PW magnitude vector is reconstructed depending on the voicing measure flag, obtained from the nonstationarity measure index. The PW magnitude vector is interpolated linearly across the frame at each subframe. For unvoiced frames (voicing measure flag=1), the VAD flag corresponding to the look-ahead frame is decoded from the PW magnitude index. For voiced frames, the VAD flag is set to 1 to represent active speech.

Based on the voicing measure and the nonstationarity measure, a phase model is used to derive a PW phase vector for each subframe. The interpolated PW magnitude vector at each subframe is combined with a phase vector from the phase model to obtain a complex PW vector for each subframe.

Out-of-band components of the PW vector are attenuated. The level of the PW vector is restored to the RMS value represented by the PW gain vector. The PW vector, which is a frequency domain representation of the pitch cycle waveform of the residual, is transformed to the time domain by an interpolative sample-by-sample pitch cycle inverse DFT operation. The resulting signal is the excitation that drives the LP synthesis filter, constructed using the interpolated LP parameters. Prior to synthesis, the LP parameters are bandwidth broadened to eliminate sharp spectral resonances during background noise conditions. The excitation signal is filtered by the all-pole LP synthesis filter to produce reconstructed speech. Adaptive postfiltering with tilt correction is used to mask coding noise and improve the peceptual quality of speech.

The pitch period is inverse quantized by a simple table lookup operation using the pitch index. It is converted to the radian pitch frequency corresponding to the right edge of the frame by $$\hat{\omega}(160) = \frac{2\pi}{\hat{p}}. \tag{118}$$

where $\hat{p}$ is the decoded pitch period. A sample by sample pitch frequency contour is created by interpolating between the pitch frequency of the left edge $\omega(0)$ and the pitch frequency of the right edge $\omega(160)$:

$$\hat{\omega}(n) = \frac{(160-n)\hat{\omega}(0) + n\hat{\omega}(160)}{160}, \; 0 \le n \le 160. \tag{119}$$

If there are abrupt discontinuities between the left edge and the right edge pitch frequencies, the above interpolation is modified as in the case of the encoder. Note that the left edge pitch frequency $\omega(0)$ is the right edge pitch frequency of the previous frame.

The index of the highest pitch harmonic within the 4000 Hz band is computed for each subframe by $$\hat{K}_m = \left\lfloor \frac{\pi}{\hat{\omega}(20m)} \right\rfloor, \; 1 \le m \le 8. \tag{120}$$

The LSFs are quantized by a hybrid scalar-vector quantization scheme. The first 6 LSFs are scalar quantized using a combination of intraframe and interframe prediction using 4 bits/LSF. The last 4 LSFs are vector quantized using 7 bits.

The inverse quantization of the first 6 LSFs can be described by the following equations:

$$\hat{\lambda}(m) = \begin{cases} S_{L,m}(l^*_{L_S_m}) + 0.375\hat{\lambda}_{prev}(m+1), & m = 0 \\ S_{L,m}(l^*_{L_S_m}) + 0.375\left(\hat{\lambda}_{prev}(m+1) - \hat{\lambda}_{prev}(m-1)\right) + \hat{\lambda}(m-1), & 1 \le m \le \end{cases}$$

Here, $\{l^*_{L_S_m}, 0 \leqq m < 6\}$ are the scalar quantizer indices for the first 6 LSFs, $\{\lambda(m), 0 \leqq m < 6\}$ are the first 6 decoded LSFs of the current frame and $\{\lambda_{prev}(m), 0 \leqq m \leqq 10\}$ are the decoded LSFs of the previous frame, $\{S_{L,m}(l), 0 \leqq m \leqq 6, 0 \leqq l \leqq 15\}$ are the 16 level scalar quantizer tables for the first 6 LSFs.

The last 4 LSFs are inverse quantized based on the predetermined mean values $\lambda_{dc}(m)$ and the received vector quantizer index for the current frame:

$$\lambda(m) = V_L(l^*_{L_V}, m-6) + \lambda_{dc}(m) + 0.5(\lambda_{prev}(m) - \lambda_{dc}(m)), \quad 6 \leqq m \leqq 9.$$

Here, $l^*_{L_V}$ is the vector quantizer index for the last 4 LSFs, $\{\lambda(m), 0 \leqq m < 6\}$ and $\{V_L(l,m), 0 \leqq l \leqq 127, 0 \leqq m < 3\}$ is the 128 level, 4-dimensional codebook for the last 4 LSFs. The stability of the inverse quantized LSFs is checked by ensuring that the LSFs are monotonically increasing and are separated by a minimum value of preferably 0.008. If this property is not satisfied, stability is enforced by reordering the LSFs in a monotonically increasing order. If a minimum separation is not achieved, the most recent stable LSF vector from a previous frame is substituted for the unstable LSF vector.

When the received frame is inactive, the decoded LSF's are used to update an estimate for background LSF's using the following recursive relationship:

$$\lambda_{bgn}(m) = 0.98\lambda_{bgn}(m) + 0.02\lambda(m), \; 0 \leqq m \leqq 9 \tag{123}$$

In order to improve the performance of the codec 100 in the presence of background noise, we replace the curent decoded LSF's by an interpolated version of the inverse quantized LSF's, background noise LSF's, and a DC value of the background noise LSF's during frames that are not only active but which follow another active frame, i.e., $$\lambda(m) = 0.25\lambda(m) + 0.25\lambda_{bgn}(m) + 0.5\lambda_{bgn,dc}(m), \; 0 \leqq m \leqq 9 \tag{124}$$

For transitional frames, i.e., frames which are transitioning from active to inactive or vice-versa, the interpolation weights are altered to favor the inverse quantized LSF's, i.e., $$\lambda(m) = 0.5\lambda(m) + 0.25\lambda_{bgn}(m) + 0.25\lambda_{bgn,dc}(m), \; 0 \leqq m \leqq 9 \tag{125}$$

The inverse quantized LSFs are interpolated each subframe by linear interpolation between the current LSFs $\{\lambda(m), 0 \leqq m \leqq 10\}$ and the previous LSFs $\{\lambda_{prev}(m), 0 \leqq m \leqq 10\}$. The interpolated LSFs at each subframe are converted to LP parameters $\{\hat{a}_m(l), 0 \leqq m \leqq 10, 1 \leqq l \leqq 8\}$.

Inverse quantization of the PW nonstationarity measure and the voicing measure is a table lookup operation. If $l^*_R$ is the index of the composite nonstationarity measure and the voicing measure, the decoded nonstationarity measure is $$\hat{\mathfrak{R}}_{11}(i) = V_R(l^*_R, i), \; 1 \leqq i \leqq 5. \tag{126}$$

Here, $\{V_R(l,m), 0 \leqq l \leqq 63, 1 \leqq m \leqq 6\}$ is the 64 level, 6-dimensional codebook used for the vector quantization of the composite nonstationarity measure vector. The decoded voicing measure is $$\nu = V_R(l^*_R, 6). \tag{127}$$

A voicing measure flag is also created based on $l^*_R$ as follows:

$$\hat{\nu}_{flag} = \begin{cases} 0 & l^*_R > 7 \\ 1 & l^*_R \le 7. \end{cases} \tag{128}$$

This flag determines the mode of inverse quantization used for PW magnitude.

The decoded nonstationarity measure may have excessive values due to the small number of bits used in encoding this vector. This leads to excessive roughness during highly periodic frames, which is undesirable. To control this problem, during sustained intervals of highly periodic frames the decoded nonstationarity measure is subjected to upper limits, determined based on the decoded voicing measure. If $l^*_{R_prev}$ denotes the nonstationarity measure index received for the preceding frame, these rules can be expressed as follows:

$$\hat{\Re}_2(0) = \begin{cases} \mathrm{MIN}\left(\hat{\Re}_1(0),\ 0.05 + \dfrac{0.95}{1 + e^{-8(\hat{v}-0.35)}}\right), & l^*_R > 31 \text{ and } l^*_{R_prev} > 31 \\ \hat{\Re}_t(0) & \text{otherwise.} \end{cases}$$

$$\hat{\Re}_2(1) = \begin{cases} \mathrm{MIN}\left(\hat{\Re}_1(1),\ \dfrac{1}{1 + e^{-8(\hat{v}-0.25)}}\right), & l^*_R > 31 \text{ and } l^*_{R_prev} > 31 \\ \hat{\Re}_1(1) & \text{otherwise.} \end{cases}$$

$$\hat{\Re}_2(2) = \begin{cases} \mathrm{MIN}(\hat{\Re}_1(2),\ 0.25 + 2.83333(\hat{v} - 0.05)), & l^*_R > 31 \text{ and } l^*_{R_prev} > 31 \\ \hat{\Re}_1(2) & \text{otherwise.} \end{cases}$$

$$\hat{\Re}_2(3) = \begin{cases} \mathrm{MIN}(\hat{\Re}_1(3),\ 0.45 + 2.83333(\hat{v} - 0.05)), & l^*_R > 31 \text{ and } l^*_{R_prev} > 31 \\ \hat{\Re}_1(3) & \text{otherwise.} \end{cases}$$

$$\hat{\Re}_2(4) = \begin{cases} \mathrm{MIN}(\hat{\Re}_1(4),\ 0.55 + 2.83333(\hat{v} - 0.05)), & l^*_R > 31 \text{ and } l^*_{R_prev} > 31 \\ \hat{\Re}_1(4) & \text{otherwise.} \end{cases}$$

In addition, for sustained intervals of highly periodic frames, it is desirable to prevent excessive changes in the nonstationarity measure from one frame to the next. This is achieved by allowing a maximum amount of permissible change for each component of the nonstationarity measure. The changes that result in a decrease of the nonstationarity measure are not limited. Rather, the changes that increase the nonstationarity measure are limited by this procedure. If $\hat{\Re}_{1prev}$ denotes the modified nonstationarity measure of the preceding frame, this procedure can be summarized as follows:

$$\hat{\Re}(0) = \begin{cases} \mathrm{MIN}(\hat{\Re}_3(0),\ \hat{\Re}_{prev}(0) + 0.06), & l^*_R > 31 \text{ and } l^*_{R_prev} > 31 \\ \hat{\Re}_1(0) & \text{otherwise.} \end{cases} \tag{134}$$

$$\hat{\Re}(1) = \begin{cases} \mathrm{MIN}(\hat{\Re}_2(1),\ \hat{\Re}_{prev}(1) + 0.10), & l^*_R > 31 \text{ and } l^*_{R_prev} > 31 \\ \hat{\Re}_1(1) & \text{otherwise.} \end{cases}$$

$$\hat{\Re}(2) = \begin{cases} \mathrm{MIN}(\hat{\Re}_2(2),\ \hat{\Re}_{prev}(2) + 0.16), & l^*_R > 31 \text{ and } l^*_{R_prev} > 31 \\ \hat{\Re}_1(2) & \text{otherwise.} \end{cases}$$

$$\hat{\Re}(3) = \begin{cases} \mathrm{MIN}(\hat{\Re}_2(3),\ \hat{\Re}_{prev}(3) + 0.24), & l^*_R > 31 \text{ and } l^*_{R_prev} > 31 \\ \hat{\Re}_1(3) & \text{otherwise.} \end{cases}$$

-continued $$\hat{\Re}(4) = \begin{cases} \mathrm{MIN}(\hat{\Re}_2(4),\ \hat{\Re}_{prev}(4) + 0.27), & l^*_R > 31 \text{ and } l^*_{R_prev} > 31 \\ \hat{\Re}_1(4) & \text{otherwise.} \end{cases}$$

The gain vector is inverse quantized by a table look-up operation. It is then linearly transformed to reverse the trasformation at the encoder. If $l^*_g$ is the gain index, the gain values for the even indexed subframes are obtained by $$\hat{g}_{pw}(2m) = \frac{90 - V_g(l^*_g, m)}{20}, \quad 1 \le m \le 4. \tag{135}$$

where, $\{V_g(l,m), 0 \leqq l \leqq 255, 1 \leqq m \leqq 4\}$ is the 256 level, 4-dimensional gain codebook.

The gain values for the odd indexed subframes are obtained by linearly interpolating between the even indexed values:

$$\hat{g}_{pw}(2m-1) = 0.5(\hat{g}_{pw}(2m-2) + \hat{g}_{pw}(2m)), 1 \leqq m \leqq 4. \tag{136}$$

The gain values are now expressed in logarithmic units. They are converted to linear units by $$\hat{g}'_{pw}(m) = 10^{\hat{g}_{pw}(m)}, 1 \leqq m \leqq 8. \tag{137}$$

This gain vector is used to restore the level of the PW vector during the generation of the excitation signal.

Based on the decoded gain vector in the log domain, long term average gain values for inactive frames and active unvoiced frames are computed. These gain averages are useful in identifying inactive frames that were marked as active by the VAD. This can occur due to the hangover employed in the VAD or in the case of certain background noise conditions such as babble noise. By identifying such frames, it is possible to improve the performance of the codec 100 for background noise conditions.

Figure 7:
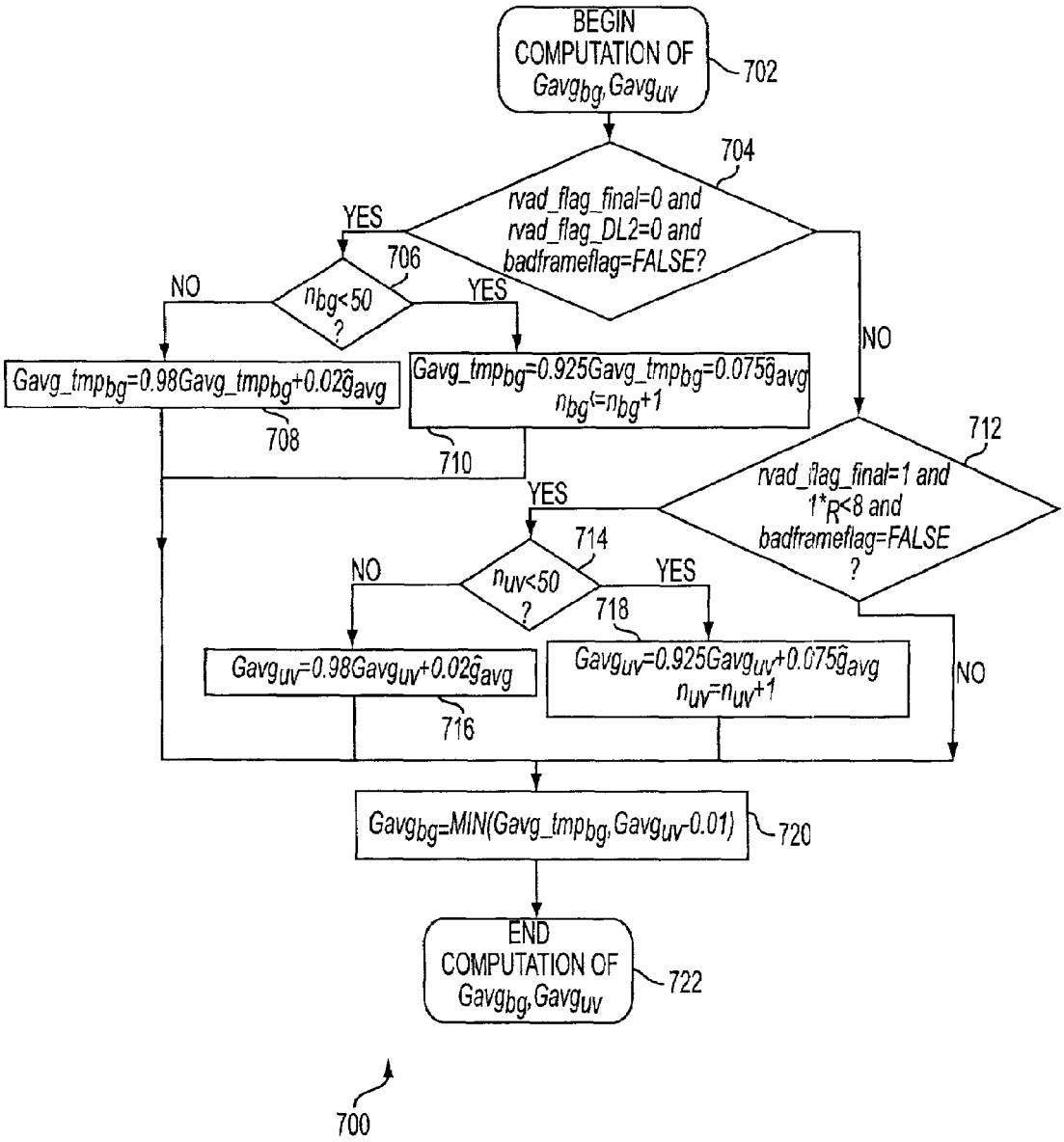
FIG. 7 is a flow chart for a method for computing gain averages in accordance with an embodiment of the present invention.

FIG. 7 is a flowchart for a method 700 for computing gain averages in accordance with an embodiment of the present invention. The method 700 is performed at the decoder 100B prior to being processed by modules 124 and 126 and is initiated at 702 where computation of $Gavg_{bg}$ and $Gavg_{uv}$ begins. The method 700 then proceeds to step 704 where a determination is made as to whether rvad_flag_final and rvad_flag_DL2 equal zero and badframe flag is false is met. If the determination is negative, the method proceeds to step 712.

At step 712 a determination is made as to whether rvad_flag_final equals a one and $l_R$ is less than 8 and bad frame flag equals false, if the determination is negative the method proceeds to step 720. If the determination is affirmative, the method proceeds to step 714.

At step 714 a determination is made as to whether $n_{uv}$ is less than 50. If the determination is answered negatively then the method proceeds to step 716 where $Gavg_{uv}$ is calculated using a first equation. If the method is answered negatively, the method proceeds to step 718 where a second equation is used to calculate $Gavg_{uv}$.

If the determination at step 704 is negative, the method proceeds to step 706 where a determination of whether nbg is less than 50 is determined. If the determination is answered negatively, the method proceeds to step 708 where Gavg-tmp$_{bg}$ is calculated using a first equation. If the determination is answered affirmatively, the method proceeds to step 710 where Gavg-tmp$_{bg}$ is calculated using a second equation.

The steps 708, 710, 716, 718 and 712 proceed to step 720 where Gavg$_{bg}$ is calculated. The method then proceeds to step 722 where the computation ends for Gavg$_{bg}$ and Gavg$_{uv}$.

First an average gain is computed for the entire frame:

$$\hat{g}_{avg} = \frac{1}{8}\sum_{m=1}^{8} \hat{g}_{pw}(m). \tag{138}$$

Long term average gains for inactive frames which represent the background signal and unvoiced frames are computed according to the method 700.

The decoded voicing measure flag determines the mode of inverse quantization of the PW magnitude vector. If $\theta_{flag}$ is a zero, voiced mode is used and if $\theta_{flag}$ is a one, unvoiced mode is used.

In the voiced mode, the PW mean is transmitted once per frame and the PW deviation is transmitted twice per frame. Further, interframe predictive quantization is used in this mode. In the unvoiced mode, mean and deviation components are transmitted twice per frame. Prediction is not employed in the unvoiced mode.

In the unvoiced mode, the VAD flag is explicitly encoded using a binary index $I^*_{VAD_UV}$. In this mode, VAD flag is decoded by $$\text{RVAD_FLAG} = \begin{cases} 0 & I^*_{\text{VAD_UV}} = 0 \\ 1 & I^*_{\text{VAD_UV}} = 1. \end{cases} \tag{139}$$

In the voiced mode, it is implicitly assumed that the frame is active speech. Consequently, it is not necessary to explicitly encode the VAD information. VAD flag is set to 1 indicating active speech in the voiced mode:

$$\text{RVAD_FLAG}=1. \tag{140}$$

It should be noted that the RVAD_FLAG is the VAD flag corresponding to the look-ahead frame where RVAD_FLAG,RVAD_FLAG_DL1,RVAD_FLAG_DL2 denote the VAD flags of the look-ahead frame, current frame and the previous frame respectively. A composite VAD value, RVAD_FLAG_FINAL, is determined for the current frame, based on the above VAD flags, according to the following table 2:

TABLE 2

| RVAD_FLAG_DL2 | RVAD_FLAG_DL1 | RVAD_FLAG | RVAD_FLAG_FINAL |
|---|---|---|---|
| 0 | 0 | 0 | 0 |
| 0 | 0 | 1 | 1 |
| 0 | 1 | 0 | 0 |
| 0 | 1 | 1 | 2 |
| 1 | 0 | 0 | 1 |
| 1 | 0 | 1 | 3 |
| 1 | 1 | 0 | 2 |
| 1 | 1 | 1 | 3 |

The RVAD_FLAG_FINAL is zero for frames in inactive regions, three in active regions, one prior to onsets and a two prior to offsets. Isolated active frames are treated as inactive frames and vice versa.

In the unvoiced mode, the mean vectors for subframes 4 and 8 are inverse quantized as follows:

$$D_m(i)=P_{DC_UV}(i)+V_{PWM_UV}(I^*_{PWM_UV_m}, i) 0 \leqq i \leqq 6, \quad m=4,8. \tag{141}$$

Here, $\{D_4(i), 0 \leqq i \leqq 6\}$ and $\{D_8(i), 0 \leqq i \leqq 6\}$ are the inverse quantized 7-band subband PW mean vectors, $\{V_{PWM_UV}(l, i), 0 \leqq l \leqq 127, 0 \leqq i \leqq 6\}$ is the 7-dimensional, 128 level unvoiced mean codebook. $I^*_{PWM_UV_4}$ and $I^*_{PWM_UV_8}$ are the indices for mean vectors for the $4^{th}$ and $8^{th}$ subframes. $\{P_{DC_UV}(i), 0 \leqq i \leqq 6\}$ is a predetermined DC vector for the unvoiced mean vectors.

Due to the limited accuracy of PW mean quantization in the unvoiced mode, it is possible to have high values of PW mean at high frequencies. This in conjunction with a LP synthesis filter which emphasizes high frequencies can cause excessive high frequency content in the reconstructed speech, leading to poor voice quality. To control this condition, the PW mean values in the uppermost two subbands is attenuated if it is found to be high and the LP synthesis filter has a frequency response with a high frequency emphasis.

The magnitude squared frequency response of the LP synthesis filter is averaged across two bands, 0–2 kHz and 2–4 kHz:

$$S_{lb} = \sum_{k=1}^{\left\lfloor \frac{\hat{K}_8}{2} \right\rfloor} \frac{1}{\left| \sum_{m=0}^{10} \hat{a}_8(m) e^{-j\hat{w}(160)km} \right|^2} \tag{142}$$

$$S_{hb} = \sum_{k=1+\left\lfloor \frac{\hat{K}_8}{2} \right\rfloor}^{2\left\lfloor \frac{\hat{K}_8}{2} \right\rfloor} \frac{1}{\left| \sum_{m=0}^{10} \hat{a}_8(m) e^{-j\hat{w}(160)km} \right|^2}. \tag{143}$$

Here, $\{\hat{a}_8(m)\}$ are the decoded, interpolated LP parameters for the $8^{th}$ sub frame of the current frame, $\hat{w}(160)$ is the decoded pitch frequency in radians for the $160^{th}$ sample of the current frame and $\lfloor\ \rfloor$ denotes truncation to integer. A comparison of the low band sum $S_{lb}$ against the high band SUM $S_{hb}$ can reveal the degree of high frequency emphasis in the LP synthesis filter.

An average of the PW magnitude in the $1^{st}$ 5 subbands is computed, for subframes 4 and 8, as follows:

$$\overline{\hat{D}}_m = \frac{1}{5}\sum_{i=0}^{4} \hat{D}_m(i), \quad m = 4, 8. \tag{144}$$

Figure 8:
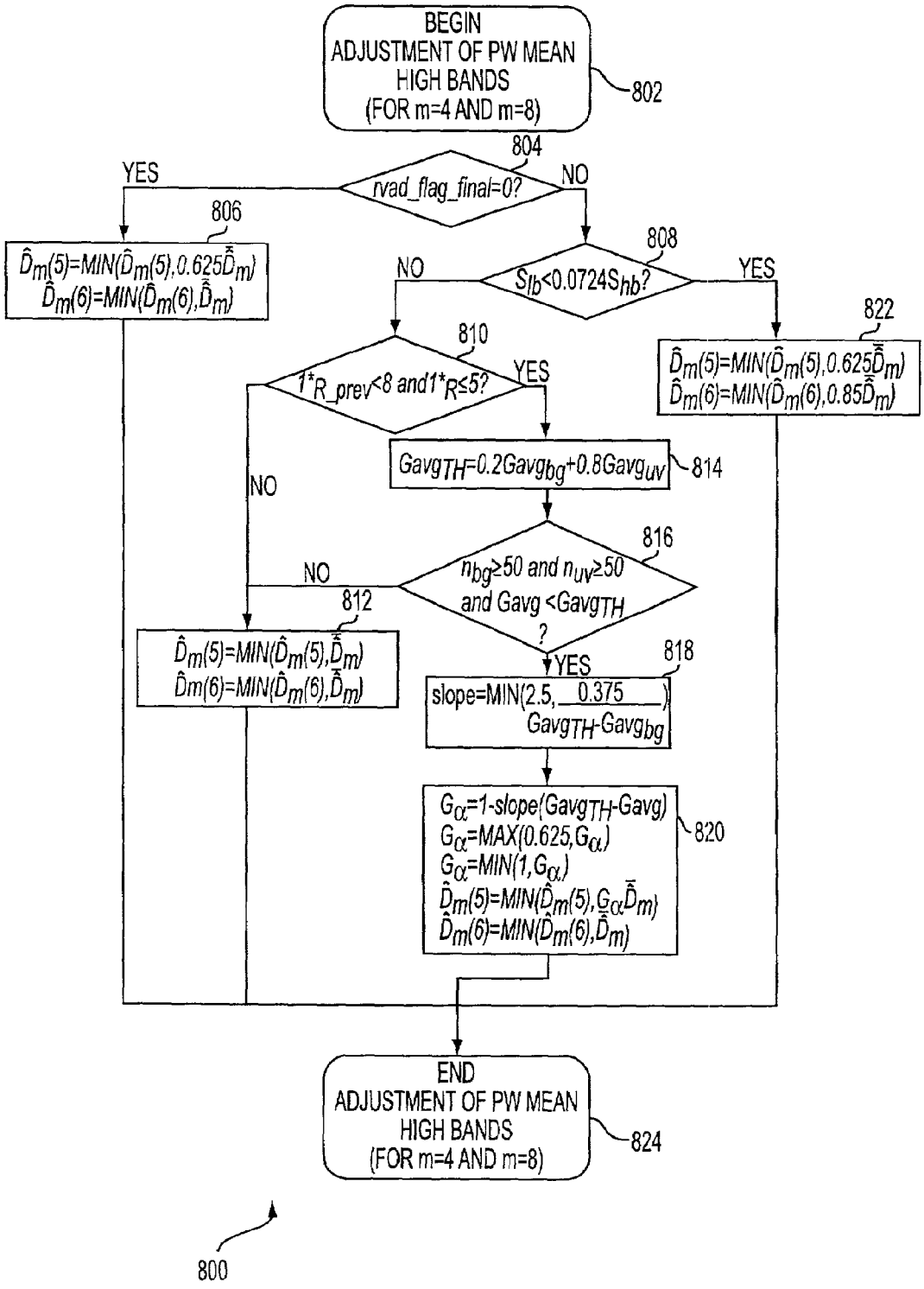
FIG. 8 is a flow chart for a method for computing the attenuation of a PW mean high in the unvoiced high frequency band in accordance with an embodiment of the present invention.

The attenuation of the PW mean in the $6^{th}$ and $7^{th}$ subbands is performed according to the flowchart 800 in FIG. 8.

FIG. 8 is a flow chart depicting a method 800 for computing the attenuation of PW mean high frequency in the unvoiced bands in accordance with an embodiment of the present invention. The method 800 is performed at the decoder 100B prior to being processed by modules 124 and 126 and is initiated at step 802 where the adjustment of PW mean high frequency bands is begun for subframes 4 and 8. The method proceeds to step 804 where a determination of whether rvad_flag_final equals zero is determined. If the determination is answered negatively, the method proceeds to step 806 where $D_m$ (5) and $D_m$ (6) are calculated. If the determination is answered negatively, the method proceeds to step 808.

At step 808, a determination is made as to whether $S_{lb}$ is less than $0.0724S_{hb}$. If the determination is answered negatively the method proceeds to step 810 where a determination is made as to whether $1^*_{R_Pev}$ is less than 8 and $1^*_R$ is less than or equal to 5. If the determination at step 810 is answered negatively the method proceeds to step 812 where $D_m(5)$ and $D_m(6)$ are calculated. If the determination at step 812 is answered affirmatively, the method proceeds to step 814.

At step 814, the $Gavg_{Th}$ is computed. The method then proceeds to step 816 where a determination is made as to whether $n_{bg}$ is greater than or equal to 50, $n_{uv}$ is greater than or equal to 50, and Gavg is less than $Gavg_{Th}$. If the determination is answered negatively the method proceeds to step 812. If the determination is answered affirmatively the method proceeds to step 818.

At step 818, the slope is calculated. The method then proceeds to step 820 where $G_\alpha$, $D_m$ (5) and $D_m$ (6) are calculated.

If the determination at step 808 is answered affirmatively, the method proceeds to step 822 where $D_m$ (5) and $D_m$ (6) are calculated. The method then proceeds to step 824.

Steps 806, 822, 820 and 822 all proceed to step 824 where the adjustment for the PW mean ends for subframes 4 and 8.

The deviation vectors for subframes 4 and 8 are inverse quantized as follows:

$$F_m(k)=V_{PWD_UV}(l^*_{PWD_UV_m},k),1\leqq k\leqq 10,m=4,8. \tag{145}$$

Here, $\{F_4(k),1\leqq k\leqq 10\}$ and $\{F_8(k),1\leqq k\leqq 10\}$ are the inverse quantized PW deviation vectors. $\{V_{PWD_UV}(l,k), 0\leqq l\leqq 63,1\leqq k\leqq 10\}$ is the 10-dimensional, 64 level unvoiced deviations codebook. $l^*_{PWD_UV_4}$ and $l^*_{PWD_UV_8}$ are the indices for deviations vectors for the $4^{th}$ and $8^{th}$ subframes.

The subband mean vectors are converted to fullband vectors by a piecewise constant approximation across frequency. This requires that the subband edges in Hz are translated to subband edges in terms of harmonic indices. Let the band edges in Hz be defined by the array $$B_{pw}=[1\ 400\ 800\ 1200\ 1600\ 2000\ 2600\ 3400]. \tag{146}$$

The band edges can be computed by $$\kappa_m(i) = \begin{cases} 2+\left\lfloor \frac{B_{pw}(i)\hat{K}_m}{4000} \right\rfloor & \left\{1+\left\lfloor \frac{B_{pw}(i)\hat{K}_m}{4000} \right\rfloor\right\} < \frac{B_{pw}(i)\pi}{4000\hat{\omega}_m}, \\ \left\lfloor \frac{B_{pw}(i)\hat{K}_m}{4000} \right\rfloor & \left\lfloor \frac{B_{pw}(i)\hat{K}_m}{4000} \right\rfloor > \frac{B_{pw}(i)\pi}{4000\hat{\omega}_m}, \\ 1+\left\lfloor \frac{B_{pw}(i)\hat{K}_m}{4000} \right\rfloor & \text{otherwise.} \end{cases},$$

$$0 \le i \le 7, \quad m = 4$$

The full band PW mean vectors are constructed at subframes 4 and 8 by $$\hat{S}_m(k) = \begin{cases} 0 & \hat{\kappa}_m(0) > k, \quad m = 4, 8, \\ \hat{D}_m(i), & \hat{\kappa}_m(i) \le k < \hat{\kappa}_m(i+1), \quad 0 \le i \le 6, \quad m = 4, 8, \\ 0 & \hat{\kappa}_m(7) \le k \le \hat{K}_m, \quad m = 4, 8. \end{cases}$$

The PW magnitude vector can then be reconstructed for subframes 4 and 8 by adding the full band PW mean vector to the deviations vector. In the unvoiced mode, the deviations vector is assumed to be zero at the unselected harmonic indices.

$$\hat{P}_m(k + kstart_m) = \begin{cases} 0 & k = 0, \quad m = 4, 8, \\ \mathrm{MAX}\left(0.15, \hat{S}_m(k + kstart_m) + \hat{F}_m(k)\right), & 1 \le k \le 10, \quad m = 4, \\ \mathrm{MAX}\left(0.15, \hat{S}_m(k + kstart_m)\right), & 11 \le k \le \hat{K}_m, \quad m = \\ 0 & \hat{K}_m < k \le 60, \quad m = 4, 8 \end{cases}$$

Here, $kstart_m$ is computed in the same manner as in the encoder in equation (107).

The PW magnitude vector is reconstructed for the remaining subframes by linearly interpolating between sub frames 0 and 4 (for subframes 1, 2 and 3) and between subframes 4 and 8 (for subframes 5, 6 and 7):

$$\hat{P}_m(k) = \begin{cases} \frac{(4-m)\hat{P}_0(k) + m\hat{P}_4(k)}{4}, & 0 \le k \le \hat{K}_m, \quad m = 1, 2, 3, \\ \frac{(8-m)\hat{P}_4(k) + (m-4)\hat{P}_8(k)}{4}, & 0 \le k \le \hat{K}_m, \quad m = 5, 6, 7. \end{cases} \tag{150}$$

In the voiced mode, the mean vector for subframe 8 is inverse quantized based on interframe prediction:

$$D_8(i)=\mathrm{MAX}(0.1, P_{DC_V}(i)+0.5(D_0(i)-P_{DC_V}(i))+V_{PWM_V}(l^*_{PWM_V}, i))0\leqq i$$

Here, $\{D_8(i),0\leqq i\leqq 6\}$ is the 7-band subband PW mean vector, $\{V_{PWM_V}(l,i),0\leqq l\leqq 127,0\leqq i\leqq 6\}$ is the 7-dimensional, 128 level voiced mean codebook, $l^*_{PWM_V}$ is the index for mean vector $8^{th}$ subframe and $\{P_{DC_V}(i),0\leqq i\leqq 6\}$ is a predetermined DC vector for the voiced mean vectors. Since the mean vector is an average of PW magnitudes, it should be nonnegative. This is enforced by the maximization operation in the above equation.

As in the case of unvoiced frames, if the values of PW mean in the highest two bands are excessive, and this occurs in conjuntion with LP synthesis filter with a high frequency emphasis, attenuation is applied to the PW mean values in the highest two bands. The magnitude squared frequency response of the LP synthesis filter is averaged across two bands, 0–2 kHz and 2–4 kHz, as in the unvoiced mode. An average of the PW magnitude in the $1^{st}$ 5 subbands is computed for subframe 8, as in the unvoiced mode. Based on these values, the PW mean in the upper two bands is attenuated according to the flowchart shown in FIG. 9.

Figure 9:
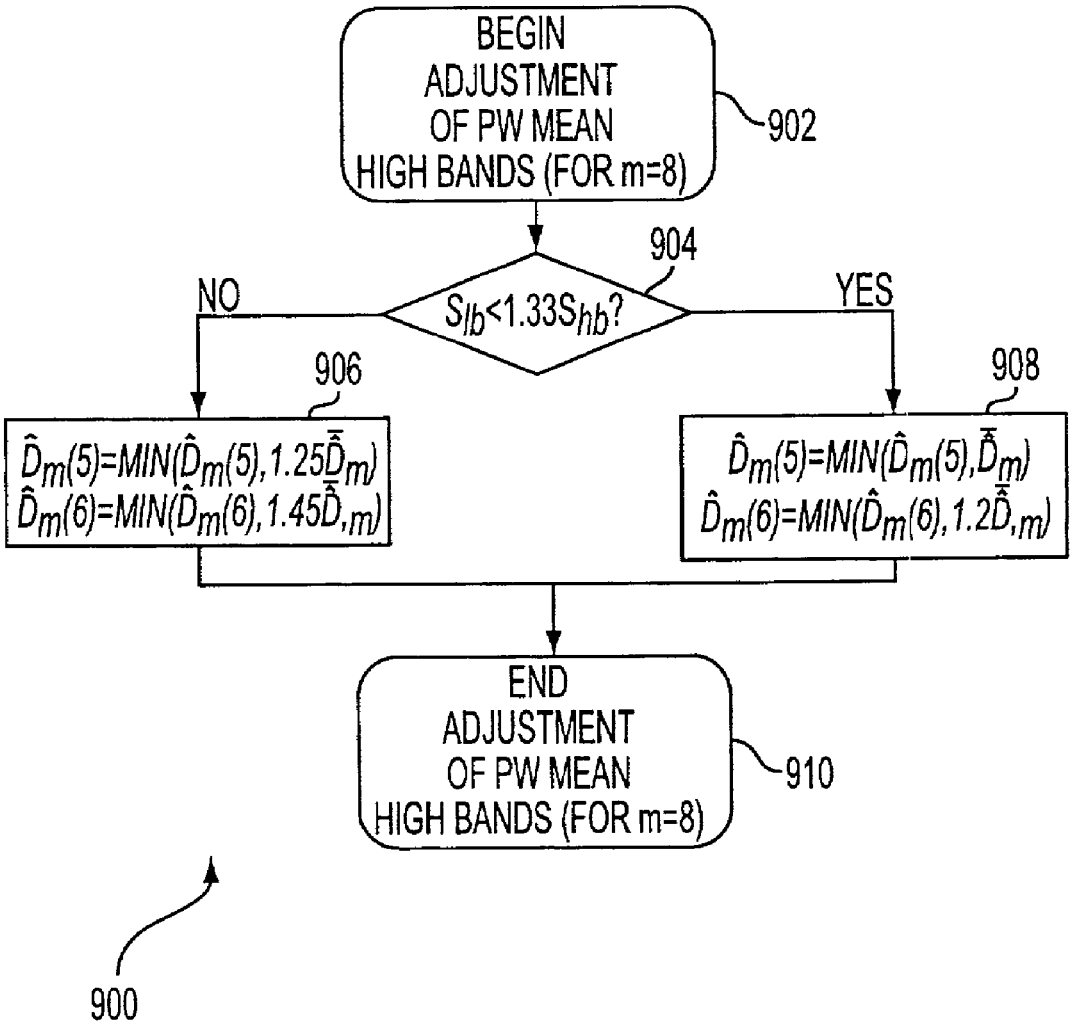
FIG. 9 is a flow chart for a method for computing the attenuation of a PW mean high in the voice high frequency band in accordance with an embodiment of the present invention.

FIG. 9 is a flow chart of a method 900 for attenuating PW mean high frequency voice bands. The method 900 is performed at the decoder 100B prior to being processed by modules 124 and 126 and is initiated at step 902 where the adjustment for the PW mean high frequency voice band for subframe 8 begins. The method then proceeds to step 904.

At step 904 a determination is made as to whether S1b is less than $1.33S_{hb}$. If the determination is answered negatively, the method proceeds to step 906 where $D_m$ (5) and $D_m$ (6) are calculated using a first equation. If the determination at step 904 is answered affirmatively, the method proceeds to step 908 where $D_m$ (5) and $D_m$ (6) are calculated using a second equation.

Steps 906 and 908 proceed to step 910 where the adjustment of the PW mean for high frequency bands for subframe 8 ends.

A subband mean vector is constructed for subframe 4 by linearly interpolating between subframes 0 and 8:

$$D_4(i)=0.5(D_0(i)+D_8(i)),\ 0\leqq i\leqq 6. \tag{152}$$

The full band PW mean vectors are constructed at subframes 4 and 8 by $$\hat{S}_m(k)=\begin{cases}0 & \hat{\kappa}_m(0)>k,\ m=4,8,\\ \hat{D}_m(i), & \hat{\kappa}_m(i)\le k<\hat{\kappa}_m(i+1),\quad 0\le i\le 6,\quad m=4,8,\\ 0 & \hat{\kappa}_m(7)\le k\le \hat{K}_m,\quad m=4,8.\end{cases}$$

The harmonic band edges $\{\kappa_m(i),\ 0\leqq i\leqq 7\}$ are computed as in the case of unvoiced mode.

The voiced deviation vectors for subframes 4 and 8 are predictively quantized by a multistage vector quantizer with 2 stages. These prediction error vectors are inverse quantized by adding the contributions of the 2 codebooks:

$$B_m(k)=V_{PWD_V1}(l^*_{PWD_V1_m}k)+V_{PWD_V2}(l^*_{PWD_V2_m}k),\quad 1\leqq i\leqq 10, m=4,8$$

Here, $\{B_4(i),0\leqq i\leqq 9\}$ and $\{B_8(i),0\leqq i\leqq 9\}$ are the PW deviation prediction error vectors for subframes 4 and 8 respectively. $\{V_{PWD_V1}(l,k),0\leqq l\leqq 63,1\leqq k\leqq 10\}$ is the 10-dimensional, 64 level voiced deviations codebook for the $1^{st}$ stage. $\{V_{PWD_V2}(l,k),0\leqq l\leqq 15,1\leqq k\leqq 10\}$ is the 10-dimensional, 16 level voiced deviations codebook for the $2^{nd}$ stage. $l^*_{PWD_V1_4}$ and $l^*_{PWD_{V2}4}$ are the $1^{st}$ and $2^{nd}$ stage indices for the deviations vector for the $4^{th}$ subframe. $l^*_{PWD_V1_8}$ and $l^*_{PWD_V2_8}$ are the $1^{st}$ and $2^{nd}$ stage indices for the deviations vector for the $8^{th}$ subframe. The deviations vectors are constructed by adding the predicted components to the prediction error vectors:

$$F_m(k)=B_m(k)+0.55F_0(k),\ 1\leqq k\leqq 10, m=4,8. \tag{155}$$

It should be noted that $\{F_0(k),1\leqq k\leqq 10\}$ is the decoded deviations vector from subframe 8 of the previous frame. If the previous frame was unvoiced, this vector is set to zero. The PW magnitude vector can then be reconstructed for subframes 4 and 8 by adding the full band PW mean vector to the deviations vector. The deviations vector is assumed to be zero at the unselected harmonic indices.

$$\hat{P}_m(k+kstart_m)=\begin{cases}0 & k=0,\quad m=4,8,\\ \mathrm{MAX}(0.1,\hat{S}_m(k+kstart_m)+\hat{F}_m(k)), & 1\le k\le 10,\quad m=4\\ \mathrm{MAX}(0.1,\hat{S}_m(k+kstart_m)), & 11\le k\le \hat{K}_m,\quad m=\\ 0 & \hat{K}_m<k\le 60,\quad m=4\end{cases}$$

Here, $kstart_m$ is computed in the same manner as in the encoder in equation (107).

The PW magnitude vector is reconstructed for the remaining subframes by linearly interpolating between subframes 0 and 4 (for subframes 1, 2 and 3) and between subframes 4 and 8 (for subframes 5, 6 and 7):

$$\hat{P}_m(k)=\begin{cases}\dfrac{(4-m)\hat{P}_0(k)+m\hat{P}_4(k)}{4}, & 0\le k\le \hat{K}_m,\quad m=1,2,3,\\ \dfrac{(8-m)\hat{P}_4(k)+(m-4)\hat{P}_8(k)}{4}, & 0\le k\le \hat{K}_m,\quad m=5,6,7.\end{cases}$$

It should be noted that {IP (i),0<i<60} is the decoded PW magnitude vector from subframe 8 of the previous frame.

In the FDI codec 100, there is no explicit coding of PW phase. The salient characteristics related to the phase, such as the degree of stationarity of the PW (i.e., periodicity of the time domain residual) and the variation of the stationarity as a function of frequency are encoded in the form of the quantized voicing measure $\nu$ and the vector nonstationarity measure $\hat{\mathfrak{R}}_1$respectively. A PW phase vector is constructed for each subframe based on this information by a two step process. In this process, the phase of the PW is modeled as the phase of a weighted complex vector sum of a stationary component and a nonstationary component.

In the first step, a stationary component is constructed using the decoded voicing measure $\nu$. First a complex vector is constructed, by a weighted combination of the following: the phase vector of the stationary component of the previous, i.e., $m-1^{th}$, sub-frame $\{\bar{\phi}_{m-1}(k),0\leqq k\leqq K_{m-1}\}$, a random phase vector $\{\gamma_m(k),0\leqq k\leqq K_m\}$, and a fixed phase vector that is obtained from a residual voiced pitch pulse waveform $\{\phi_{fix}(k),0\leqq k\leqq K_m\}$.

In order to combine the previous phase vector which has $K_{m-1}$ components with the random phase vector which has $K_m$ components, it may be necessary to used a modified version of the previous phase vector. If there is no pitch discontinuity between the previous and the current subframes, this modification is simply a truncation (if $K_{m-1}>K_m$) or padding by random phase values (if $K_{m-1}<K_m$). If there is a pitch discontinuity, it is necessary to align the two phase vectors such that the harmonic frequencies corresponding to the vector elements are as close as possible. This may require either interlacing or decimating the previous phase vector. For example, if the pitch period of the current subframe is roughly l-times that of the previous subframe, l $K_{m-1} \cong K_m$. In this case, each element of the previous phase vector is interlaced with l−1 random phase values. On the other hand, if the the pitch period of the previous subframe is roughly l-times that of the current subframe, $K_{m-1} \cong lK_m$. In this case, for each element of the previous phase vector, the next l-1 elements are dropped. In either case, the dimension of the modified previous phase vector will have the same dimension as that for the current subframe. The modified previous phase vector will be denoted by $\{\psi_{m-1}(k), 0 \leqq k \leqq K_m\}$.

The random phase vector provides a method of controlling the degree of stationarity of the phase of the stationary component. However, to prevent excessive randomization of the phase, the random phase component is not allowed to change every subframe, but is changed after several subframes depending on the pitch period. Also, the random phase component at a given harmonic index alternates in sign in successive changes. At the $1^{st}$ sub-frame in every frame, the rate of randomization for the current frame is determined based on the pitch period. For highly aperiodic frames, the highest rate of randomization is used regardless of the pitch period. The subframes for which the random vector is updated can be summarized as follows:

rate 1: m=1,3,5,7 $l^*_R \leqq 7$ or $20 \leqq \hat{p} < 64$ rate 2: m=1,4,6 $l^*_R \leqq 7$ and $64 \leqq \hat{p} \leqq 90$ rate 3: m=1,5, $l^*_R \leqq 7$ and $90 < \hat{p} \leqq 120$.

In addition, abrupt changes in the update rate of the random phase, i.e., from rate 1 in the previous frame to the rate 3 in the current frame or vice-versa are not permitted. Such cases are modified to the rate 2 in the current frame. Controlling the rate at which the phase is randomized is quite important to prevent artifacts in the reproduced signal, especially in the presence of background noise. If the phase is randomized every subframe, it leads to a fluttering of the reproduced signal. This is due to the fact that such a randomization is not representative of natural signals.

The random phase value is determined by a random number generator, which generates uniformly distributed random numbers over a sub-interval of 0-πradians. The sub-interval is determined based on the decoded voicing measure $\nu$ and a stationarity measure ζ(m). A weighted sum of the elements of the nonstationary measure vector for the current frame is computed by $$\eta = \begin{cases} 0.55\hat{\Re}(0) + 0.49\hat{\Re}(1) + 0.35\hat{\Re}(2) + 0.21\hat{\Re}(3) & l^*_R > 7 \\ 0.32\hat{\Re}(0) + 0.32\hat{\Re}(1) + 0.32\hat{\Re}(2) + 0.32\hat{\Re}(3) + 0.32\hat{\Re}(4) & l^*_R \leq 7. \end{cases}$$

This is a scalar measure of the nonstationarity of the current frame. If $\theta_{prev}$ is the corresponding value for the previous frame, an interpolated stationarity measure is computed for each subframe is obtained by:

$$\zeta(m) = \begin{cases} \mathrm{MAX}\left[0.65, \dfrac{8}{((8-m)\eta_{prev} + m\eta)}\right] & l^*_R \leq 7, \\ \dfrac{8}{((8-m)\eta_{prev} + m\eta)} & l^*_R > 7 \end{cases} \quad 1 \leq m \leq 8.$$

The sub-interval of [0−π] used for phase randomization is $[\pi\mu_1/2 - \pi\mu_1]$, where $\mu_1$ is determined based on the following rule depending on the stationarity of the subframe:

$$\mu_1 = \begin{cases} 0.5 - 0.25\zeta(m) & l^*_R > 7 \text{ and } \zeta(m) < 1.0, \\ 0.25 + 0.0625(1 - \zeta(m)) & l^*_R > 7 \text{ and } \zeta(m) < 3.0, \\ 0.125 & l^*_R > 7 \text{ and } \zeta(m) \geq 3.0, \\ 1.0 & l^*_R \leq 7 \text{ and } \zeta(m) < 1.0, \\ 1.0 + 0.125(1 - \zeta(m)) & l^*_R \leq 7 \text{ and } \zeta(m) < 3.0, \\ 0.75 & l^*_R \leq 7 \text{ and } \zeta(m) \geq 3.0. \end{cases}$$

As the subframe becomes more stationary (ζ(m) relatively high valued), $\mu_1$ takes on lower values, thereby creating smaller values of random phase perturbation. As the stationarity of the subframe decreases, $\mu_1$ takes on higher values, resulting in higher values of random phase perturbation. Uniformly distributed random numbers in the interval $$\left[\frac{\pi\mu_1}{2} - \pi\mu_1\right]$$

are used as random phases. In addition, the sign of the the random phase at any given harmonic index is alternated from one update to the next, to remove any bias in phase randomization. The weighted phase combination of the random phase, previous phase and fixed phase is performed in two steps. In the $1^{st}$ step, the random phase and the previous phase are added directly resulting in a randomized previous phase vector:

$$\xi_m(k) = \psi_{m-1}(k) + \gamma_m(k), 0 \leqq k \leqq K_m. \tag{161}$$

In the $2^{nd}$ step, the randomized phase vector as well as the fixed phase vector are combined with unity magnitude and a weighted vector addition is performed. This results in a complex vector, which in general does not have unity magnitude:

$$\left.\begin{aligned} \mathrm{Re}[U'_m(k)] &= \cos(\xi_m(k))\alpha_1 + \cos(\varphi_{fix}(k))(1 - \alpha_1), \\ \mathrm{Im}[U'_m(k)] &= \sin(\xi_m(k))\alpha_1 + \sin(\varphi_{fix}(k))(1 - \alpha_1), \end{aligned}\right\} 0 \leq k \leq \hat{K}_m.$$

where, $\alpha_1$ is a weighting factor determined based on the quantized voicing measure $\nu$ and the stationarity measure ζ(m) computed by:

$$\alpha_1 = \begin{cases} 0.5 - 0.2\zeta(m) & l^*_R > 7 \text{ and } \zeta(m) < 1.0, \\ 0.3 + 0.1(1 - \zeta(m)) & l^*_R > 7 \text{ and } \zeta(m) < 3.0, \\ 0.1 & l^*_R > 7 \text{ and } \zeta(m) \geq 3.0, \\ 1.0 - 0.2\zeta(m) & l^*_R \leq 7 \text{ and } \zeta(m) < 1.0, \\ 0.8 + 0.15(1 - \zeta(m)) & l^*_R \leq 7 \text{ and } \zeta(m) < 3.0, \\ 0.5 & l^*_R \leq 7 \text{ and } \zeta(m) \geq 3.0. \end{cases}$$

As the subframe becomes more stationary (ζ(m) relatively high valued), $\alpha_1$ takes on lower values, increasing the contribution of the fixed phase vector. Conversely, as the stationarity of the subframe decreases, $\alpha_1$ takes on higher values, increasing the contribution of the randomized phase.

The resulting vector is normalized to unity magnitude as follows:

$$U_m^n(k) = \frac{U_m'(k)}{|U_m'(k)|^2} \quad 0 \le k \le \hat{K}_m. \tag{164}$$

Also, the phase of this vector is computed to serve as the previous phase during the next subframe:

$$\bar{\varphi}_m(k) = \arctan\left(\frac{\mathrm{Im}[U_m''(k)]}{\mathrm{Re}[U_m''(k)]}\right) \quad 0 \le k \le \hat{K}_m. \tag{165}$$

The above normalized vector is passed through an evolutionary low pass filter (i.e., low pass filtering along each harmonic track) to limit excessive variations, so that a signal having stationary characteristics (in the evolutionary sense) is obtained. Stationarity implies that variations faster than 25 Hz are minimal. However, due to phase models used and the random phase component it is possible to have excessive variations. This is undesirable since it produces speech that is rough and lacks naturalness during voiced sounds. The low pass filtering operation overcomes this problem. Delay constraints preclude the use of linear phase FIR filters. Consequently, second order IIR filters are employed. The filter transfer function is given by $$H_{phl}(z) = \frac{b_0 + b_1 z^{-1} + b_2 z^{-2}}{1 + a_1 z^{-1} + a_2 z^{-2}}. \tag{166}$$

The filter parameters are obtained by interpolating between two sets of filter parameters. One set of filter parameters corresponds to a low evolutionary bandwidth and the other to a much wider evolutionary bandwidth. The interpolation factor is selected based on the stationarity measure ($\zeta(m)$), so that the bandwidth of the LPF constructed by interpolation between these two extremes allows the right degree of stationarity in the filtered signal. The filter parameters corresponding to low evolutionary bandwidth are:

$$a_{op} = 1,\ a_{1p} = -1.77\cos\left(\frac{10\pi}{250}\right),\ a_{2p} = 1.77, \tag{167}$$

$$b_{op} = 1/7,\ b_{1p} = -0.2\cos\left(\frac{40\pi}{250}\right),\ b_{2p} = 0.07.$$

The filter parameters corresponding to high evolutionary bandwidth are:

$a_{oop}$=1, $a_1ap$=−1.523326, $a_2ap$=0.6494950, $b_{oop}$=0.395304917, $b_1ap$=−0367045695, $b_2op$=0.146146091.

The interpolation parameter is computed based on the stationarity measure as follows:

$$\alpha_2 = \begin{cases} 0.2 & I_R^* > 7 \text{ and } \zeta(m) < 1.0, \\ 0.2 + 0.2(1 - \zeta(m)) & I_R^* > 7 \text{ and } \zeta(m) < 2.0, \\ 0 & I_R^* > 7 \text{ and } \zeta(m) \ge 2.0, \\ 1.0 & I_R^* \le 7 \text{ and } \zeta(m) < 1.0, \\ 1.0 + 0.32(1 - \zeta(m)) & I_R^* \le 7 \text{ and } \zeta(m) < 3.5, \\ 0.2 & I_R^* \le 7 \text{ and } \zeta(m) \ge 3.5. \end{cases}$$

It is desirable to prevent excessive variations in $\alpha_2$ from one subframe to the next, as this would result in large variations in the filter characteristics. A modified interpolation parameter $\beta_2$ is computed by introducing hysteresis as follows:

$$\beta_2 = \begin{cases} \mathrm{MIN}[1.0,\ \beta_{2prev} + \mathrm{MAX}(0.2\beta_{2prev},\ 0.05)], & \alpha_2 > \beta_{2prev} + \mathrm{MAX}(0.2\beta_{2prev},\ 0.05), \\ \mathrm{MAX}[0.0,\ \beta_{2prev} - \mathrm{MAX}(0.3\beta_{2prev},\ 0.05)], & \alpha_2 > \beta_{2prev} - \mathrm{MAX}(0.3\beta_{2prev},\ 0.05), \\ \alpha_2 & \text{otherwise.} \end{cases} \tag{170}$$

Here, $\beta_{2prev}$ is the modified interpolation parameter $\beta_2$ computed during the preceding subframe. The interpolated filter parameters are computed by:

$$\left.\begin{aligned} a_j &= \beta_2 a_{jap} + (1 - \beta_2) a_{jp}, \\ b_j &= \beta_2 b_{jap} + (1 - \beta_2) b_{jp}, \end{aligned}\right\} j = 0, 1, 2.$$

The evolutionary low pass filtering operation is represented by $$\hat{U}_m(k) = U''_m(k) + b_1 U''_{m-1}(k) + b_2 U''_{m-2}(k) - a_1 \hat{U}_{m-1}(k) - a_2 \hat{U}_{m-2}(k),\ 0 \le k \le K_m,\ 0 \le m \le 8. \tag{172}$$

It should be noted that, if there is a pitch discontinuity, the filter state vectors, (i.e., $U''_{m-1}(k)$,$U''_{m-2}(k)$,$\hat{U}_{m-1}(k)$,$\hat{U}_{m-2}(k)$) can require truncation, interlacing and/or decimation to align the vector elements such that the harmonic frequencies are paired with minimal discontinuity. This procedure is similar to that described for the previous phase vector above.

The phase spectrum of the resulting stationary component vector $\hat{U}_m(k)$ has the desired evolutionary characteristics, consistent with the stationary component of the residual signal at the encoder 100A.

In the second step of phase construction, a nonstationary PW component is constructed, also using the decoded voicing measure $\nu$. The nonstationary component is expected to have some correlation with the stationary component. The correlation is higher for periodic signals and lower for aperiodic signals. To take this into account, the nonstationary component is constructed by a weighted addition of the stationary component and a complex random signal. The random signal has unity magnitude at all the harmonics.

In other words, only the phase of the random signal is randomized. In addition, the RMS value of the random signal is normalized such that it is equal to the RMS value of the stationary component, computed by:

$$\hat{G}_s = \sqrt{\frac{\sum_{k=1}^{\hat{K}_m} |\hat{U}_m(k)|^2}{\hat{K}_m}}. \tag{173}$$

The weighting factor used in combining the stationary and noise components is computed based on the voicing measure and the nonstationarity measure quantization index by:

$$\beta_3 = \begin{cases} 0.775 - \dfrac{0.625}{1 + e^{-5(\hat{v}-0.25)}} & I_R^* > 7, \\ 0.835 - \dfrac{0.835}{1 + e^{-9(\hat{v}-0.425)}} & I_R^* \le 7. \end{cases} \tag{174}$$

The weighting factor is increases with the periodicity of the signal. Thus, for periodic frames, the correlation between the stationary and nonstationary components is higher than for aperiodic frames. In addition, this correlation is expected to decrease with increasing frequency. This is incorporated by decreasing the weighting factor with increasing harmonic index:

$$\partial_3(k) = \beta_3 - \frac{(0.5 + 0.5\hat{v})\beta_3}{\hat{K}_m} k,\ 0 \le k \le \hat{K}_m. \tag{175}$$

Thus, the weighting factor decreases linearly from $\beta_3$ at k=0 to $\beta_3-(0.5+0.5\nu)\beta_3$ at $k=K_m$. The slope of this decrease is higher for aperiodic frames; i.e., for aperiodic frames the correlation with the stationary component starts at a lower value and decreases more rapidly than for periodic frames. The nonstationary component is then computed by:

$$R_m(k)=\partial_3(k)\hat{U}_m(k)+[1-\partial_3(k)]G'_S N'_m(k), 0 \le k \le K_m. \tag{176}$$

Here $\{N'_m(k), 0 \le k \le K_m\}$ is the unity magnitude complex random signal and $\{R_m(k), 0 \le k \le K_m\}$ is the nonstationary PW component.

The stationary and nonstationary PW components are combined by a weighted sum to construct the complex PW vector. The subband nonstationarity measure determines the frequency dependent weights that are used in this weighted sum. The weights are detemined such that the ratio of the RMS value of the nonstationary component to that of the stationary component is equal to the decoded nonstationarity measure within each subband. From equation 90, the band edges in Hz are defined by the array $$B_{rs}=[1\ 400\ 800\ 1600\ 2400\ 3400].$$

As in the case of the encoder 100A, the subband edges in Hz are translated to subband edges in terms of harmonic indices such that the $i^{th}$ subband contains harmonics with indices $\{\theta(i-1) \le k < \theta(i), 1 \le i \le 5\}$:

$$\hat{\eta}(i) = \begin{cases} 2 + \left\lfloor \dfrac{B_{rs}(i)\hat{K}_m}{4000} \right\rfloor & \left\{1 + \left\lfloor \dfrac{B_{rs}(i)\hat{K}_m}{4000} \right\rfloor\right\} < \dfrac{B_{rs}(i)\pi}{4000\omega_m}, \\ \left\lfloor \dfrac{B_{rs}(i)\hat{K}_m}{4000} \right\rfloor & \left\lfloor \dfrac{B_{rs}(i)\hat{K}_m}{4000} \right\rfloor > \dfrac{B_{rs}(i)\pi}{4000\omega_m}, \\ 1 + \left\lfloor \dfrac{B_{rs}(i)\hat{K}_m}{4000} \right\rfloor & \text{otherwise.} \end{cases},$$

$$0 \le i \le 5.$$

The energy in each subband is computed by averaging the squared magnitude of each harmonic within the subband. For the stationary component, the subband energy distribution for the $m^{th}$ subframe is computed by $$E\hat{S}_m(l) = \frac{1}{2(\hat{\eta}(l) - \hat{\eta}(l-1))} \sum_{k=\hat{\eta}_m(l-1)}^{\hat{\eta}_m(l)-1} |\hat{U}_m(k)|^2 \quad 1 \le l \le 5. \tag{178}$$

For the nonstationary component, the subband energy distribution for the $m^{th}$ subframe is computed by $$E\hat{R}_m(l) = \frac{1}{2(\hat{\eta}(l) - \hat{\eta}(l-1))} \sum_{k=\hat{\eta}_m(l-1)}^{\hat{\eta}_m(l)-1} |\hat{R}_m(k)|^2 \quad 1 \le l \le 5. \tag{179}$$

The subband weighting factors are computed by $\{\theta(i-1) \le k < \theta(i), 1 \le i \le 5\}$ $$G_{sb}(k) = \sqrt{\frac{E\hat{S}_m(l)}{E\hat{R}_m(l)}},\ \forall k : \hat{\eta}(l-1) \le k < \hat{\eta}(l),\ 1 \le l \le 5. \tag{180}$$

Since the bandedges exclude out-of-band components, it is necessary to explicitly initialize the weighting factors for the out-of-band components:

$$G_{sb}(k) = \sqrt{\frac{E\hat{S}_m(1)}{E\hat{R}_m(1)}},\ 0 \le k < \hat{\eta}(0), \tag{181}$$

$$G_{sb}(k) = \sqrt{\frac{E\hat{S}_m(5)}{E\hat{R}_m(5)}},\ \hat{K}_m \ge k \ge \hat{\eta}(5).$$

The complex PW vector can now be constructed as a weighted combination of the complex stationary and complex nonstationary components:

$$V_m'(k)=\hat{U}_m(k)+R_m(k)G_{sb}(k), 0 \le k \le K_m,\ 1 \le m \le 8. \tag{182}$$

However, it should be noted that this vector will have the desired phase characteristics, but not the decoded PW magnitude. To obtain a PW vector with the decoded magnitude and the desired phase, it is necessary to normalize the above vector to unity magnitude and multiply it with the decoded magnitude vector:

$$\hat{V}''_m(k) = \frac{\hat{V}'_m(k)}{|\hat{V}'_m(k)|}\hat{P}_m(k),\ 0 \le k \le \hat{K}_m,\ 1 \le m \le 8. \tag{183}$$

This vector is the reconstructed (normalized) PW magnitude vector for subframe m.

The inverse quantized PW vector may have high valued components outside the band of interest. Such components can deteriorate the quality of the reconstructed signal and should be attenuated. At the high frequency end, harmonics above 3400 Hz are attenuated. At the low frequency end, only the DC component (i.e., the 0 Hz component) is attenuated. The attenuation characteristic is linear from 1 at the bandedge to 0 at 4000 Hz. The attenuation process can be specified by:

$$\hat{V}'''_m(k) = \begin{cases} 0 & k = 0, \\ \hat{V}''_m(k) & 1 \le k < k_{um}, \\ \hat{V}''_m(k)\dfrac{4000(\pi - k\hat{\omega}_m)}{600\pi} & k_{um} \le k \le \hat{K}_m. \end{cases}$$

where, $k_{um}$ is the index of the lowest pitch harmonic that falls above 3400 Hz. It is obtained by $$k_{um} = \left\lfloor \frac{3400}{4000}\hat{K}_m \right\rfloor + 1. \tag{185}$$

Certain types of background noise can result in LP parameters that correspond to sharp spectral peaks. Examples of such noise are babble noise and interfering talker. Peaky spectra during background noise is undesirable since it leads to a highly dynamic reconstructed noise that interferes with the speech signal. This can be mitigated by a mild degree of bandwidth broadening that is adapted based on the RVAD_FLAG_FINAL computed according to table 3.6.3-3. Bandwidth broadening is also controlled by the nonstationarity index. If the index takes on values above 7, indicating an voiced frame, no bandwidth broadening is applied. For values of the nonstationarity index 7 or lower, a bandwidth broadening factor is selected jointly with the RVAD_FLAG_FINAL according to the following equation:

$$\phi = \Phi(2RVAD_FLAG_FINAL + VM_INDEX) \tag{186}$$

where VM_INDEX is related to $l^*_R$ as follows:

$$VM_INDEX = MIN(3, \mathrm{MAX}(0, (l^*_R - 5))) \tag{187}$$

and the 9-dimensional array Φ is defined as follows in Table 3:

TABLE 3

| Φ(0) | Φ(1) | Φ(2) | Φ(3) | Φ(4) | Φ(5) | Φ(6) | Φ(7) | Φ(8) |
|---|---|---|---|---|---|---|---|---|
| 0.96 | 0.96 | 0.96 | 0.97 | 0.975 | 0.98 | 0.99 | 0.99 | 0.99 |

Bandwidth broadening is performed only during intervals of voice inactivity. Bandwidth expansion increases as the frame becomes more unvoiced. Onset and offset frames have a lower degree of bandwidth broadening compared to frames during voice inactivity. Bandwidth expansion is applied to interpolated LPC parameters as follows:

$$\hat{a}'_m(j) = \hat{a}_m(j)\phi^m 0 \le m \le 10,\ 1 \le j \le 8. \tag{188}$$

The level of the PW vector is restored to the RMS value represented by the decoded PW gain. Due to the quantization process, the RMS value of the decoded PW vector is not guaranteed to be unity. To ensure that the right level is achieved, it is necessary to first normalize the PW by its RMS value and then scale it by the PW gain. The RMS value is computed by $$g_{rms}(m) = \sqrt{\frac{1}{2\hat{K}_m + 2}\sum_{k=0}^{\hat{K}_m}|\hat{V}'''_m(k)|^2}\quad 1 \le m \le 8. \tag{189}$$

The PW vector sequence is scaled by the ratio of the PW gain and the RMS value for each subframe:

$$\hat{V}_m(k) = \frac{\hat{g}'_{pw}(m)}{g_{rms}(m)}\hat{V}'''_m(k)\ 0 \le k \le \hat{K}_m,\ 1 \le m \le 8. \tag{190}$$

The excitation signal is constructed from the PW using an interpolative frequency domain synthesis process. This process is equivalent to linearly interpolating the PW vectors bordering each subframe to obtain a PW vector for each sample instant, and performing a pitch cycle inverse DFT of the interpolated PW to compute a single time-domain excitation sample at that sample instant.

The interpolated PW represents an aligned pitch cycle waveform. This waveform is to be evaluated at a point in the pitch cycle (i.e., pitch cycle phase), advanced from the phase of the previous sample by the radian pitch frequency. The pitch cycle phase of the excitation signal at the sample instant determines the time sample to be evaluated by the inverse DFT. Phases of successive excitation samples advance within the pitch cycle by phase increments determined by the linearized pitch frequency contour.

The computation of the $n^{th}$ sample of the excitation signal in the $m^{th}$ sub-frame of the current frame can be conceptually represented by $$\hat{e}(20(m-1)+n) = \frac{1}{20(\hat{K}_m+1)}\sum_{k=0}^{\hat{K}_m}\left[(20-n)\hat{V}_{m-1}(k) + n\hat{V}_m(k)\right]e^{j\theta(20(m-1)-n)k},\quad 0 \le n < 20,\ 0 < m \le 8,\ 0 \le \tag{191}$$

where, θ(20(m−1)+n) is the pitch cycle phase at the $n^{th}$ sample of the excitation in the $m^{th}$ sub-frame. It is recursively computed as the sum of the pitch cycle phase at the previous sample instant and the pitch frequency at the current sample instant:

$$\theta(20(m-1)+n) = \theta(20(m-1)+n-1) + \omega((20(m-1)+n),\quad 0 \le n \le 20 \tag{192}$$

This is essentially a numerical integration of the sample-by-sample pitch frequency track to obtain the sample-by-sample pitch cycle phase. It is also possible to use trapezoidal integration of the pitch frequency track to get a more accurate and smoother phase track by $$\theta(20(m-1)+n)=\theta(20(m-1)+n-1)+0.5[\omega(20(m-1)+n-1)+\omega(20(m-1)+n)]\quad 0\leqq n\leqq 20 \tag{193}$$

In either case, the first term circularly shifts the pitch cycle so that the desired pitch cycle phase occurs at the current sample instant. The second term results in the exponential basis functions for the pitch cycle inverse DFT.

The approach above is a conceptual description of the excitation synthesis operation. Direct implementation of this approach is possible, but is highly computation intensive. The process can be simplified by using radix-2 FFT to compute an oversampled pitch cycle and by performing interpolations in the time domain. These techniques have been employed to achieve a computation efficient implementation.

The resulting excitation signal $\{\hat{e}(n), 0\leqq n\leqq 160\}$ is processed by an all-pole LP synthesis filter, constructed using the decoded and interpolated LP parameters. The first half of each sub-frame is synthesized using the LP parameters at the left edge of the sub-frame and the second half by the LP parameters at the right edge of the sub-frame. This ensures that locally optimal LP parameters are used to reconstruct the speech signal. The transfer function of the LP synthesis filter for the first half of the $m^{th}$ subframe is given by $$H_{LPm1}(z)=\frac{1}{\sum_{l=0}^{10} a_l'(m-1)z^{-1}} \tag{194}$$

and for the second half $$H_{LPm2}(z)=\frac{1}{\sum_{l=0}^{10} a_l'(m)z^{-1}} \tag{195}$$

The signal reconstruction is expressed by $$\hat{s}(20(m-1)+n)=\begin{cases}\hat{e}(20(m-1)+n)-\sum_{l=1}^{10} a_l'(m-1)\hat{s}(20(m-1)+n-l), & 0\leq n<10,\quad 0<m\leq 8\\ \hat{e}(20(m-1)+n)-\sum_{l=1}^{10} a_l'(m)\hat{s}(20(m-1)+n-l), & 10\leq n<20,\quad 0<m\leq 8.\end{cases} \tag{196}$$

The resulting signal $\{\hat{s}(n), 0\leqq n\leqq 160\}$ is the reconstructed speech signal.

The reconstructed speech signal is processed by an adaptive postfilter to reduce the audibility of the effects of modeling and quantization. A pole-zero postfilter with an adaptive tilt correction is employed as disclosed in "Adaptive Postfiltering for Quality Enhancement of Coded Speech", IEEE Transactions on Speech and Audio Processing, Vol. 3, No. 1, pages 59–71, January 1995 by J. H. Chen and A. Gersho which is incorporated by reference in its entirety.

The postfilter emphasizes the formant regions and attenuates the valleys between formants. As during speech reconstruction, the first half of the sub-frame is postfiltered by parameters derived from the LPC parameters at the left edge of the sub-frame. The second half of the sub-frame is postfiltered by the parameters derived from the LPC parameters at the right edge of the sub-frame. For the $m^{th}$ sub-frame, these two postfilter transfer functions are specified respectively by $$H_{pf1}(z)=\frac{\sum_{l=0}^{10} a_l'(m-1)\beta_{pf}^{l}z^{-l}}{\sum_{l=0}^{10} a_l'(m-1)\alpha_{pf}^{l}z^{-l}} \tag{197}$$

and $$H_{pf2}(z)=\frac{\sum_{l=0}^{10} a_l'(m)\beta_{pf}^{l}z^{-l}}{\sum_{l=0}^{10} a_l'(m)\alpha_{pf}^{l}z^{-l}} \tag{198}$$

The pole-zero postfiltering operation for the first half of the sub-frame is represented by $$\hat{s}_{pf1}(20(m-1)+n)=\sum_{l=1}^{10} a_l'(m-1)\beta_{pf}^{l}\hat{s}(20(m-1)+n-l)-\sum_{l=1}^{10} a_l'(m-1)\alpha_{pl}^{l}\hat{s}_{pf1}(20(m-1)+n-l \tag{199}$$

$$0\leq n\leq 10,\quad 0<m\leq 8.$$

The pole-zero postfiltering operation for the second half of the sub-frame is represented by $$\hat{s}_{pf1}(20(m-1)+n)=\sum_{l=1}^{10} a_l'(m)\beta_{pf}^{l}\hat{s}(20(m-1)+n-l)-\sum_{l=1}^{10} a_l'(m)\alpha_{pf}^{l}\hat{s}_{pf1}(20(m-1)+n-l), \tag{200}$$

$$10\leq n<20,\quad 0<m\leq 8.$$

where, $\alpha_{pf}$ and $\beta_{pf}$ are the postfilter parameters. These satisfy the constraint $0 \leqq \beta_{pf} < \alpha_{pf} \leqq 1$. A typical choice for these parameters is $\alpha_{pf}=0.875$ and $\beta_{pf}=0.6$.

The postfilter introduces a frequency tilt with a mild low pass characteristic to the spectrum of the filtered speech, which leads to a muffling of postfiltered speech. This is corrected by a tilt-correction mechanism, which estimates the spectral tilt introduced by the postfilter and compensates for it by a high frequency emphasis. A tilt correction factor is estimated as the first normalized autocorrelation lag of the impulse response of the postfilter. Let $\nu_{pf1}$ and $\nu_{pf2}$ be the two tilt correction factors computed for the two postfilters in equations 197 and 198, respectively. Then the tilt correction operation for the two half sub-frames are as follows:

$$\hat{s}_{pf}(20(m-1)+n) = \begin{cases} \hat{s}_{pf1}(20(m-1)+n) - 0.8\nu_{pf1}\hat{s}_{pf1}(20(m-1)+n-1), & 0 \le n < 10,\ 0 < m \\ \hat{s}_{pf1}(20(m-1)+n) - 0.8\nu_{pf2}\hat{s}_{pf1}(20(m-1)+n-1), & 10 \le n < 20,\ 0 < \end{cases} \tag{201}$$

The postfilter alters the energy of the speech signal. Hence it is desirable to restore the RMS value of the speech signal at the postfilter output to the RMS value of the speech signal at the postfilter input. The RMS value of the postfilter input speech for the $m^{th}$ sub-frame is computed by:

$$\sigma_{prepf}(m) = \sqrt{\frac{1}{20}\sum_{n=0}^{19}\hat{s}^2(20(m-1)+n)} \quad 0 < m \le 8 \tag{202}$$

The RMS value of the postfilter output speech for the $m^{th}$ sub-frame is computed by:

$$\sigma_{pf}(m) = \sqrt{\frac{1}{20}\sum_{n=0}^{19}\hat{s}^2_{pf}(20(m-1)+n)} \quad 0 < m \le 8 \tag{203}$$

An adaptive gain factor is computed by low pass filtering the ratio of the RMS value at the post filter input to the RMS value at the post filter output:

$$g_{pf}(20(m-1)+n) = 0.96 g_{pf}(20(m-1)+n-1) + 0.04\left(\frac{\sigma_{prepf1}(m)}{\sigma_{pf1}(m)}\right), \quad 0 \le n < 20,\ 1 \le m \le 8. \tag{204}$$

The postfiltered speech is scaled by the gain factor as follows:

$$s_{out}(20(m-1)+n) = g_{pf}(20(m-1)+n)\hat{s}_{pf}(20(m-1)+n), \quad 0 \le n < 20,\ 0 < m$$

The resulting scaled postfiltered speech signal $\{s_{out}(n), 0<n<160\}$ constitutes one frame (20 ms) of output speech of the decoder correponding to the received 80 bit packet.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and the following claims.

What is claimed is:

1. A frequency domain interpolative CODEC system for low bit rate coding of speech, comprising:

a linear prediction (LP) front end adapted to process an input signal providing LP parameters which are quantized and encoded over predetermined intervals and used to compute a LP residual signal;

an open loop pitch estimator adapted to process said LP residual signal, a pitch quantizer, and a pitch interpolator and provide a pitch contour within the predetermined intervals; and a signal processor responsive to said LP residual signal and the pitch contour and adapted to perform the following steps:

extract a prototype waveform (PW) from the LP residual and the open loop pitch contour for a number of equal sub-intervals within the predetermined intervals;

normalize the PW by said PW's gain;

represent a variable dimension PW in a magnitude domain without further decomposition of said PW into complex components in a mean plus deviations form in multiple bands;

compute a voicing measure, said voicing measure characterizing a degree of voicing of said input speech signal and is derived from several input parameters that are correlated to degrees of periodicity of the signal over the predetermined intervals;

provide for a voicing classification for the predetermined intervals based on the computed voicing measure; and quantize the PW multi-band mean plus deviations for all speech frames in a magnitude domain using a hierarchical quantization method that employs fixed dimension vector quantizers (VQ) with parameters based on the voicing classification.

2. A system as recited in claim 1 wherein the representation of the variable dimension PW is in fixed but unequal bands at each sub-interval, and the means are computed as a spectrally weighted average of the PW magnitude in each band and at each sub-interval.

3. A system as recited in claim 2, wherein in the quantization step a fixed dimensional PW mean vector is derived using all the PW means as its elements at each sub-interval.

4. A system as recited in claim 3, wherein for frames classified as voiced the quantization step comprises:

a backward predictive vector quantization of the fixed dimensional PW means vector for a last sub-interval;

reconstruction of the quantized PW means vector for the last sub-interval by inverse backward vector quantization; and reconstruction of the quantized PW means vector for intermediate sub-intervals by linear interpolation.

5. A systems as recited in claim 3 wherein for frames classified as unvoiced the quantization step comprises:

a backward predictive vector quantization of the fixed dimensional PW means vector for a middle sub-interval;

a backward predictive vector quantization of the fixed dimensional PW means vector for a last sub-interval;

reconstruction of the quantized PW means vector for the middle sub-interval by inverse backward predictive vector quantization;

reconstruction of the quantized PW means vector for the last sub-interval by inverse backward predictive vector quantization; and reconstruction of the quantized PW means vector for intermediate sub-intervals by linear interpolation.

6. A system as recited in claim 3 wherein the quantization step comprises:

derivation of a variable dimensional PW deviations vector as a difference between the PW magnitude spectra and a reconstructed quantized means in each band and for each sub-interval;

selection of a fixed number of perceptually significant harmonics at each of a plurality of selected time instants by a procedure that emphasizes low frequencies while precluding frequencies below 200 Hz at each said selected time instant; and conversion of the variable dimensional PW deviations vector to a fixed dimensional PW deviations vector comprising elements that are PW deviations at the selected harmonics.

7. A system as recited in claim 6 further comprising of the following steps for frames classified as voiced:

backward predictive multi-stage vector quantization of the fixed dimensional PW deviations vector for a middle sub-interval;

backward predictive multi-stage vector quantization of the fixed dimensional PW deviations vector for a last sub-interval;

reconstruction of the fixed dimensional quantized PW deviations vector for the middle sub-interval by inverse backward predictive vector quantization;

reconstruction of the fixed dimensional quantized PW deviations vector for the last sub-interval by inverse backward predictive vector quantization;

reconstruction of the variable dimensional quantized PW vector for the middle and last sub-intervals as a sum of the reconstructed quantized PW mean at each harmonic frequency plus a harmonic deviation if the harmonic frequency is one of the selected harmonics; and reconstruction of the variable dimensional quantized PW vector for intermediate sub-intervals by linear interpolation.

8. A system as recited in claim 6 further comprising of the following steps for frames classified as unvoiced:

vector quantization of the fixed dimensional PW deviations vector for a middle sub-interval;

vector quantization of the fixed dimensional PW deviations vector for a last sub-interval;

reconstruction of the fixed dimensional quantized PW deviations vector for the middle sub-interval by inverse vector quantization;

reconstruction of the fixed dimensional quantized PW deviations vector for the last sub-frame by inverse vector quantization;

reconstruction of the variable dimensional quantized PW vector for the middle and last sub-intervals as a sum of the reconstructed quantized PW mean at each harmonic frequency plus a harmonic deviation if the harmonic frequency is one of the selected harmonics; and reconstruction of the variable dimensional quantized PW vector for intermediate sub-intervals by linear interpolation.

* * * * *